United States Patent [19]

Eversole et al.

[11] 4,231,383

[45] * Nov. 4, 1980

[54] METHOD FOR CONTROLLING MASS FLOW RATE

[75] Inventors: James F. Eversole, Mamaroneck, N.Y.; Lester P. Berriman, Irvine, Calif.

[73] Assignee: Dresser Industries, Inc., Dallas, Tex.

[ * ] Notice: The portion of the term of this patent subsequent to Dec. 11, 1990, has been disclaimed.

[21] Appl. No.: 7,946

[22] Filed: Jan. 31, 1979

Related U.S. Application Data

[60] Continuation of Ser. No. 622,521, Oct. 15, 1975, Pat. No. 4,023,125, which is a division of Ser. No. 388,761, Aug. 16, 1973, Pat. No. 3,952,776, which is a continuation-in-part of Ser. No. 151,373, Jun. 9, 1971, Pat. No. 3,778,038, which is a continuation-in-part of Ser. No. 17,086, Mar. 6, 1970, abandoned.

[51] Int. Cl.[3] ..... F02M 9/00

[52] U.S. Cl. ..... 137/1; 261/50 R; 261/DIG. 56; 261/DIG. 78

[58] Field of Search ..... 137/1; 261/44 R, DIG. 56, 261/50 R, 62, DIG. 78; 60/39.74 R

[56] References Cited

U.S. PATENT DOCUMENTS

| | | | |
|---|---|---|---|
| 2,332,916 | 10/1943 | Johnson | 261/DIG. 78 |
| 2,726,073 | 12/1955 | Seld | 261/44 R |

OTHER PUBLICATIONS

"*Rocket Propulsion*", Elements of Rockets, 2nd edition, George Sutton, pp. 71–73.

*Primary Examiner*—Alan Cohan

[57] ABSTRACT

A combustible mixture of air and minute fuel droplets is produced for supply to the cylinders of an internal combustion engine. This mixture is formed by accurately controlling both the atomization of fuel and the mass flow rate of air over substantially the entire operating range of the engine. These controls are accomplished by introducing liquid fuel into a stream of intake air and uniformly distributing the fuel in the air followed by passing the air and fuel mixture through a constricted zone to increase the velocity of the mixture to sonic. The sonic velocity air at the constricted zone divides the fuel into minute droplets that are uniformly entrained throughout the air stream. The area of the constricted zone and the quantity of fuel introduced are adjustably varied in correlation with operating demands imposed upon the engine. Downstream from the constricted sonic zone, the air and fuel mixture is accelerated to supersonic velocity in a supersonic zone without imparting substantial turbulent flow thereto. Thereafter the mixture is decelerated to subsonic velocity in a subsonic zone to produce a shock zone where the fuel droplets entrained in the air are believed to be further subdivided and uniformly distributed throughout the combustible mixture before the mixture is supplied to the engine cylinders. The supersonic and subsonic velocities occur in a gradually increasing cross-sectional area corresponding to that of a conical section having an apex angle in the range of about 6 to 18 degrees.

2 Claims, 26 Drawing Figures

20
25
26
27
22
22
22
21

26a
27a
28a
25a
29a
40
37
36
31
41
4
4
33
32
5
5
34
35
39

26b
27b
28b
25b
29b 38
45
46
47

8
11
10
13
16
18
17
AIR
14
9
12
10
11
15
19

36
30
41
31

33
34
32
35
37
36
40
50
31
7
7
41
55
57
56
53
52
8
8
54

52
53
54

METHOD FOR CONTROLLING MASS FLOW RATE

RELATED APPLICATIONS

This application is a continuation application of U.S. Application Ser. No. 622,521, filed Oct. 15, 1975 now U.S. Pat. No. 4,023,125 which in turn is a divisional application of U.S. Application Ser. No. 388,761, filed Aug. 16, 1973, now U.S. Pat. No. 3,952,776, which in turn is a continuation-in-part application of U.S. application Ser. No. 151,373, filed June 9, 1971 now U.S. Pat. No. 3,778,038, which in turn is a continuation-in-part application of U.S. application Ser. No. 17,086, filed Mar. 6, 1970, now abandoned.

BACKGROUND OF THE INVENTION

The present invention relates generally to gasoline internal combustion engines and more particularly concerns a method and apparatus for mixing and modulating liquid fuel and intake air in order to reduce the undesirable exhaust emissions from such engines.

In nearly all gasoline engines used in automotive applications today, the fuel and air are metered and mixed by a carburetor connected to the intake manifold of the engine. While these carburetors differ considerably in detail, their overall operation is basically the same in that fuel is drawn from a float-controlled fuel reservoir through one or more small fuel jets by the pressure drop created as the air flows through a fixed venturi section formed in the throat of the carburetor. During normal operation the air flow through the carburetor and, hence, the amount of fuel drawn through the metering jets is controlled by a butterfly-valve-type throttle plate. However, because the air flow through the carburetor varies markedly during different engine operating conditions, such as: idle, acceleration, full throttle, and deceleration, conventional carburetors are commonly provided with separate idle jets, acceleration pumps, and multiple venturi sections. Even so, the metering function of the carburetor falls short of providing the desired air-fuel mixture to the engine at all operating conditions and the mixing function performed by the carburetor is even worse.

Except at idle essentially all of the mixing in a conventional carburetor occurs as the fuel and air pass together through the throttle opening. Assuming atmospheric pressure of 29.9 inches of mercury (in. Hg.) exists at the carburetor inlet, the air flow through the throttle opening will be at sonic velocity when the pressure at the throttle opening is 53% of atmospheric. This is equal to a pressure of 15.6 in. Hg. and is referred to as the critical pressure. However, since it is common to measure the condition within the intake manifold in terms of inches of mercury vacuum rather than pressure, this critical pressure is equal to 14.3 in. Hg. vacuum ($29.9-15.6=14.3$) and this condition will be hereinafter referred to as the threshold vacuum. Moreover, due to the shapes of the carburetor throat and throttle plate, a vacuum in the intake manifold only slightly below threshold vacuum will just produce sonic velocity through the throttle opening. This condition, which is referred to hereinafter as the "unchoking point", occurs at about 12 in. Hg. vacuum for a typical carburetor or 17.9 in. Hg. pressure ($29.9-12=17.9$). Sonic velocity of the intake air through the throttle opening also occurs at manifold vacuums above the unchoking point, in other words, in the range of about 12 to 24 in. Hg. during normal operation. Expressed slightly different, when the pressure in the intake manifold of a typical carburetor is about 60% of the pressure at the carburetor inlet ($60\% \times 29.9=17.9$) or less, sonic velocity of the intake air occurs through the throttle opening. For reasons explained below, the present invention provides sonic velocity over a wider range and even when the pressure in the intake manifold is substantially more than 60% of the pressure at the inlet.

When the velocity of the intake air through the throttle opening is at sonic velocity, the high velocity air divides the liquid fuel into fine droplets. However, because the throttle plate slopes across the carburetor throat below the fuel jet, nearly all of the fuel and about half of the air flows through the lower throttle opening but only a small amount of fuel passes with the other half of the air through the upper throttle opening. Although some mixing of these two streams of fuel and air does occur below the throttle plate, the asymmetrical distribution of the fuel in the intake air is substantially never completely overcome.

At manifold vacuum conditions below the unchoking point, the mixing of fuel and air by the carburetor is even worse. This normally occurs at all manifold vacuum conditions below about 12 inches Hg. when the engine is accelerated or under load. Under these conditions, the air flow is below sonic velocity, frequently well below, and more fuel is being introduced. The fuel distribution is still asymmetric and mixing at the throttle opening and below is even less effective due to the much larger droplets which are formed by the lower velocity air. In addition, if the carburetor includes an accelerator pump, as most do, the additional squirt of fuel that it provides usually comes just when the throttle is being opened rapidly and the air velocity is falling well below sonic. Thus, a stream of liquid fuel may pass directly into the intake manifold.

During idle conditions, the fuel is typically introduced through an idle jet located just below the lower side of the throttle plate when it is in the idle position. Naturally, this results in asymmetrical fuel distribution in the intake air and although the air flow through the throttle opening is typically at sonic velocity during idling conditions, the idle fuel is not very effectively or uniformly mixed with the intake air.

Largely, as a result of these shortcomings in current carburetor arrangements, there are wide cylinder to cylinder and cycle to cycle variations in the ratio and amount of fuel and air delivered to the engine at different operating conditions. This is true even when the metering function of the carburetor initially provides the desired air-fuel ratio at the manifold inlet because the mixing function of the carburetor is so poorly performed that streams of liquid fuel frequently pass into the intake manifold, wetting portions of the manifold walls and actually collecting in pools of liquid fuel in certain areas of the manifold, and some of this unmixed liquid fuel is inducted into the engine cylinders.

In an effort to overcome this situation, various arrangements have been adopted to heat the intake manifold in order to vaporize the liquid fuel prior to induction into the engine cylinders. The most common of such arrangements are hot spots and heat risers from the exhaust manifold to heat the area of the intake manifold immediately below the carburetor. A hot water path through the intake manifold is also frequently employed. Even with these arrangements, however, a completely uniform air-fuel mixture throughout the manifold is rarely achieved. Consequently, the air-fuel mixture delivered to some of the cylinders is often too rich to achieve complete combustion. On the other hand, the air-fuel mixture delivered to other cylinders is at times too lean to achieve proper burning and this causes those cylinders to misfire. As used in the present application, it will be understood that a rich air-fuel mixture is one that contains more than one pound of fuel for every 15.5 pounds of air and that a lean air-fuel mixture is one that contains less than one pound of fuel for every 15.5 pounds of air.

Whether the problem is misfiring due to too lean an air-fuel mixture or incomplete combustion due to too rich a mixture, the result is that unburned fuel is exhausted from the cylinders. This is undesirable not only because of the loss in power and efficiency that results but also because these unburned or incompletely burned fuel components pass into the atmosphere as undesirable pollutants.

The principal air pollutants emanating from internal combustion engines have been identified as unburned hydrocarbons (HC), carbon monoxide (CO), and the oxides of nitrogen ($NO_x$). The desired end products of complete combustion of the fuel and air, of course, would be carbon dioxide and water with only a trace of other constituents in the presence of unreacted nitrogen.

Prior to enactment of federal and state standards on exhaust emissions, a standard automobile engine in good running condition would produce an average of about 900 ppm HC, 3.9% CO and 1075 ppm $NO_x$ during normal operation. The initial federal standards, effective January, 1968, covered only HC and CO emissions and were stated in terms of concentrations of 275 ppm HC and 1.5% CO. In terms of the subsequently prescribed 7-mode cycle test which is to simulate a typical 20 minute trip of a car from cold start through city traffic, the 1968 federal standards correspond to about 3.4 g/mi HC and 34 g/mi CO. Effective January 1970, these were reduced to 2.2 g/mi HC and 23 g/mi CO which correspond to concentrations of about 180 ppm HC and 1% CO for the average car.

The standards originally proposed for 1975 (Fed. Reg. Vol. 33, No. 108, June 4, 1968) were 0.5 g/mi (about 40 ppm) of hydrocarbon, 11.0 g/mi (about 0.5%) of CO, and 0.9 g/mi (about 240 ppm) of $NO_x$, based on the 7-mode cycle, that was adopted. In 1970, new standards for 1975 and 1976 were established along with a new driving cycle (Fed. Reg. Vol. 35, No. 219, Nov. 10, 1970). On 1975 model cars, hydrocarbon must not exceed 0.46 g/mi (about 37 ppm) and CO 4.7 g/mi (about 0.2%). On 1976 model cars, it is proposed that $No_x$ be limited to 0.4 g/mi (about 110 ppm). These emissions are to be obtained using a constant volume sampling system and while driving a car through a new 22 minute driving cycle. It will be appreciated that the standards were hence reduced in two ways, by lowering the actual numbers and also by changing the analytical method.

The automobile engine manufacturers were able—with some difficulties—to meet the 1968 federal emission standards primarily by adopting one or more of the following engine modifications:

(1) retarding the spark-ignition
(2) recalibrating the carburetor for leaner air-fuel mixtures
(3) heating the intake manifold
(4) changing valve timing
(5) increasing stroke to bore ratio
(6) injecting air into the exhaust manifold
(7) improving combustion chamber design Further improvements in these areas have also made it possible to meet the federal standards for 1970.

However, the stringent nature of the federal exhaust emission standards for 1975 are such that it is believed that even the most effective combination of all of the above measures will not be sufficient even with added catalytic or thermal reactors and, indeed, serious concern is being voiced as to whether or not the internal combustion engine can economically be made sufficiently polution free to meet these projected standards.

SUMMARY OF THE INVENTION

Accordingly, it is the primary aim of the present invention to provide a new and improved liquid fuel and intake air mixing and modulating device suitable for installation on both new and used automobile engines which, without other substantial modifications, will effect a substantial reduction of all undesirable exhaust emissions in new cars to levels well below the federal requirements originally projected for 1975 and near to those now projected for 1975–76, and which will effect a substantial reduction in such emissions in used cars to a level surpassing the projected requirements for used cars.

A further object of the invention is to provide a method and apparatus for mixing and modulating liquid fuel and intake air which is effective to finely divide and entrain the liquid fuel in the intake air and to form such a substantially uniform and homogeneous mixture, preferably without the fuel being completely vaporized, so that substantially complete combustion occurs each cycle in every cylinder and that, due to the nature of the mixture formed, misfire does not occur when operating at air-fuel ratios on the order of 20:1.

A related object of the invention is to provide a new and improved liquid fuel and intake air mixing and modulating apparatus and method of the above character which, due to the nature of the air-fuel mixture formed, results in operation of the engine with combustion taking place at lower temperatures and possibly somewhat differently to thereby reduce the production of the oxides of nitrogen at peak operating conditions and also permit a reduction in the fuel octane requirement even for high compression ratio gasoline engines.

Another object of the invention is to provide a method and apparatus for mixing and modulating liquid fuel and intake air which not only satisfies the foregoing objects over substantially the entire range of engine operating conditions but which also results in improved engine response and a decrease in fuel consumption for a given power output or an increase in power output for a given fuel consumption as compared with similar engines not equipped with the liquid fuel and intake air mixing and modulating apparatus of the present invention.

Finally, it is an object to provide a liquid fuel and intake air mixing and modulating device as characterized above which is relatively inexpensive to manufacture, install and service and which is also substantially trouble free and dependable in operation.

In accordance with the present invention, method and apparatus are provided for producing a uniform combustible mixture of air and minute liquid fuel droplets for supply to the cylinders of an internal combustion engine. Liquid fuel is introduced into a stream of intake air and uniformly distributed therein. The velocity of the air and fuel mixture is substantially increased by passing it through a throat zone, and the fuel in minutely divided and uniformly entrained as droplets throughout the air at the throat zone. The area of the throat zone and the quantity of fuel introduced into the stream of intake air are adjustably varied in correlation with operating demands imposed on the engine. Downstream from the throat zone, the air and fuel mixture is accelerated to supersonic velocity in a supersonic zone. Thereafter the mixture is decelerated to subsonic velocity in a subsonic zone to produce a shock zone where the fuel droplets are believed to be further subdivided and uniformly distributed throughout the combustible mixture. The mixture is then supplied to the engine cylinders.

The air flows through the throat zone at sonic velocity throughout substantially the entire range of engine operation. Moreover, the supersonic and subsonic zones provide a gradually increasing cross-sectional area corresponding to that of a conical section having an apex angle in the range of about 6 to 18 degrees for efficient recovery of the kinetic energy of the supersonic velocity air and fuel mixture as static pressure.

The quantity of fuel delivered into the air stream may be controlled to provide a substantially constant air-to-fuel ratio of the mixture over a wide range of engine conditions. Since the air flow is maintained at sonic velocity through the throat zone over a wide range of engine conditions, the mass flow rate of air being supplied to the engine is directly proportional to the cross-sectional area of the throat zone. Thus, by controlling the rate of fuel delivered to the air stream in direct proportion to the area of the throat zone, the air-to-fuel ratio of the mixture supplied to the engine remains substantially constant.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which:

FIG. 1A is a schematic perspective of the liquid fuel and intake air mixing and modulating device of the present invention installed on the intake manifold of a gasoline engine, illustrated here in phantom;

FIG. 1B is a diagrammatic view of the liquid and intake air mixing and modulating device of the present invention;

FIGS. 11 and 12 are vertical cross-sections substantially as seen along lines 11—11 and 12—12, respectively, in FIG. 9;

DETAILED DESCRIPTION OF THE INVENTION

Figures 2A, 2B, 3:
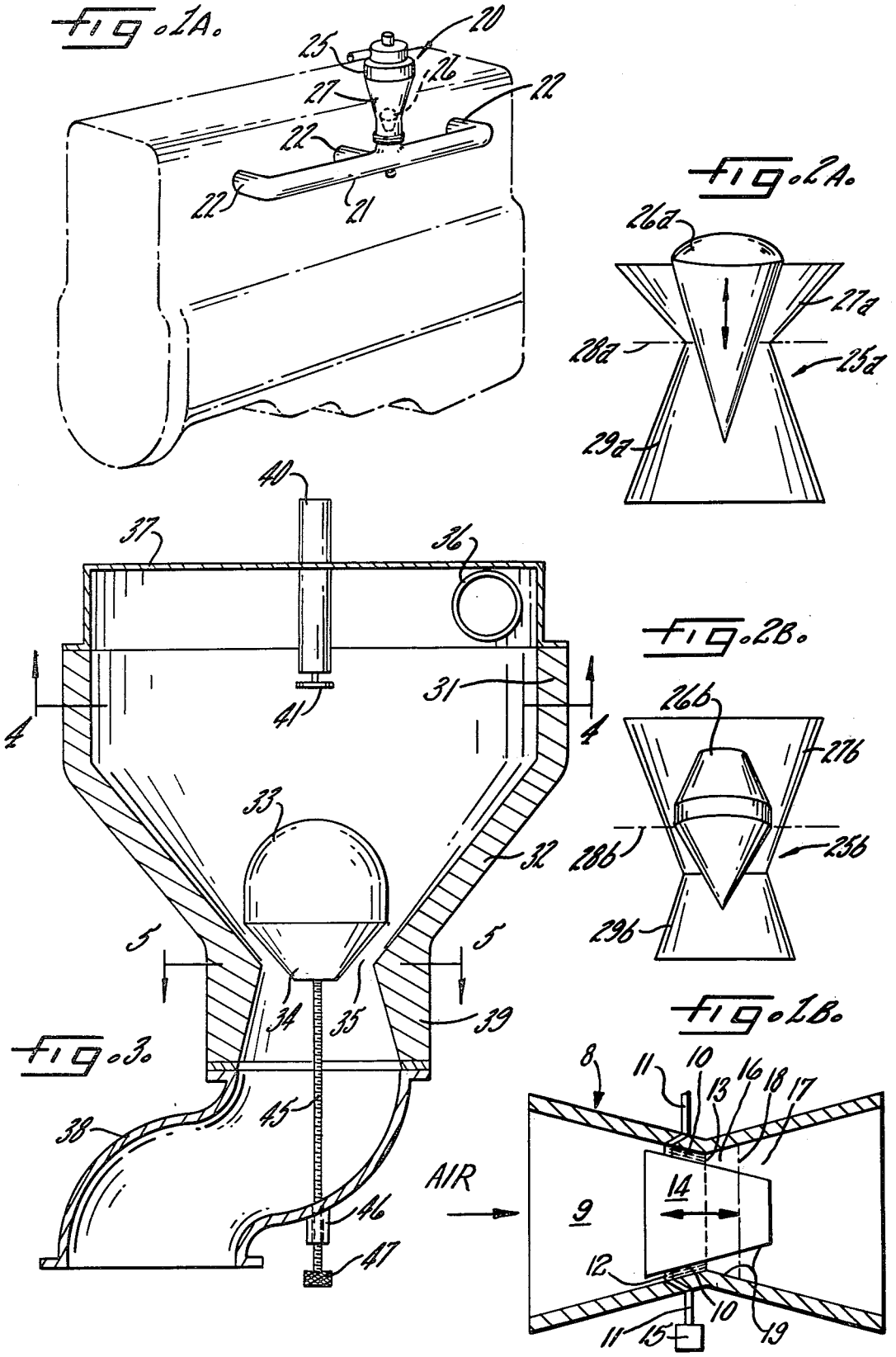
FIGS. 2A and B are somewhat exaggerated schematic illustrations of alternate throat sections for the liquid fuel and air mixing and modulating device shown in FIg. 1A.
FIG. 3 is a vertical cross-section through one form of the liquid fuel and intake air mixing and modulating device of the present invention.

Turning now to the drawings, there is shown in FIG. 1A a liquid fuel and intake air mixing and modulating device 20 of the present invention illustrated schematically as installed on the intake manifold 21 of a conventional gasoline engine, shown here in phantom. While the engine illustrated is an inline 6-cylinder engine, the liquid fuel and intake air mixing and modulating device 20 of the present invention is not limited for use on such an engine. Rather, it should be understood that the present invention is equally applicable for use with gasoline engines having different cylinder numbers and arrangements such as, for example, but without limitation: 2, 4, 6, 8 and 12 cylinders in inline, V, horizontally opposed, and rotary arragements.

As is conventional in many 6-cylinder inline engines the intake ports of the front, rear and center pairs of cylinders (not shown) are siamesed. Accordingly, as illustrated in FIG. 1A, the intake manifold 21 is provided with three branches 22, each of which serves the intake ports of a respective one of the pairs of front, rear and center cylinders. However, the invention is not limited to the illustrated manifold arrangement and the manifold may be provided with a separate branch for each cylinder, if desired.

In accordance with the present invention, the liquid fuel and intake air mixing and modulating device 20 of the present invention includes an intake air duct 25 which is provided with means for selectively constricting the flow of intake air to significantly increase the velocity thereof prior to admitting the intake air into the intake manifold 21. As shown in FIG. 1A, the illustrated means for constricting or throttling the flow of intake air includes a member 26 disposed concentrically and in axially movable relation to a converging section 27 of the intake air duct 25. In the preferred embodiment, the movable member 26 and the converging section 27 of the duct 25 are formed with generally circular cross-sections so as to define therebetween a throat in the form of an annular orifice, the cross-sectional area of which is variable as the member 26 is moved, and which defines a uniform opening around its circumference for each position of the member 26. It will be understood, of course, that other forms of throat constrictions may also be employed without departing from the present invention.

FIG. 1B diagrammatically illustrates a mixing device 8 of the present invention for supplying a uniform combustible mixture of minute liquid fuel droplets and air to the intake manifold of an internal combustion engine. Intake air is drawn through the device 8 from a converging intake air zone 9 in response to the intake manifold vacuum. As the air travels deeper into the intake air zone 9, its velocity is increased. Liquid fuel 10 from lines 11 is introduced at 12 into the intake air stream and uniformly distributed therein before the mixture passes through a throat or constricted zone 13 located between an axially movable plug or modulator 14 and the adjacent wall structure. The velocity of the air is increased to sonic in the constricted zone 13 to thereby minutely divide and uniformly entrain the fuel as droplets throughout the air stream. The cross-sectional area of the constricted zone 13 together with the quantity of fuel 10 introduced at 12 into the stream of air are adjustably varied in correlation with operating demands imposed upon the engine to which the mixture is supplied. Adjustment of the cross-sectional area of the constricted zone 13 is accomplished by axially moving the plug or modulator 14 in response to the engine demands while the quantity of fuel introduced is controlled by suitable valving 15.

As the air and fuel mixture passes downstream from the constricted zone 13 the velocity thereof is accelerated to supersonic velocity in a supersonic zone 16 without substantial turbulent flow therein. Immediately thereafter the mixture is decelerated to subsonic velocity in a subsonic zone 17 to produce shock zone 18 where the fuel droplets entrained in the air are believed to be further subdivided and uniformly distributed throughout the combustible mixture. The shock zone 18 occurs at the transition between the supersonic and subsonic zones, 16 and 17, respectively.

It is significant that the kinetic energy of the high velocity intake air and entrained fuel is efficiently recovered as static pressure in the subsonic zone 17. For efficient energy recovery, the supersonic and subsonic zones share common diverging walls 19 that provide a gradually increasing cross-sectional area corresponding to that of a conical section having an apex angle in the range of 6 to 18 degrees. Such recovery enables sonic air flow through the constricted zone 13 at all manifold vacuum levels of the engine down at least to five inches mercury vacuum. Such vacuum levels represent virtually the entire operating range of the engine. At the same time, unlike conventional carburetors, because air is maintained at sonic velocity through the constricted zone the mass flow rate of air being supplied to the engine is directly proportional to the cross-sectional area of the constricted zone. Thus, by controlling the rate of fuel delivered to the air in direct proportion of the area of the constricted zone, the air-to-fuel ratio of the mixture supplied to the intake manifold remains substantially constant. Moreover, the engine may be operated without misfire on a relatively lean and unvarying air-to-fuel ratio substantially in excess of those normally encountered in conventional carburetors.

Referring now to the schematic illustrations presented in FIGS. 2A and 2B, there are shown two exemplary forms of the means for restricting the throat of the intake air duct 25. As shown in FIG. 2A, the duct **25*a* is provided with an upper or upstream portion 27*a* of converging cross-section in the downstream direction with respect to the flow of intake air. The point of maximum constriction of the duct 25*a* is represented here by a plane 28*a* passing transversely through the duct 25*a* and below the plane 28*a* the duct is provided with a portion 29*a* of diverging cross-section. In this embodiment, the axially movable member 26*a* is formed with a converging lower end portion having an angle of convergence less than the angle of convergence of the portion 27*a* of the duct 25*a*. Since both the converging portion 27*a* of the duct and the member 26*a* are preferably formed with circular cross-sectional shapes, there is formed therebetween a variable area annular orifice or throat zone located in the plane 28*a***.

In the embodiment schematically illustrated in FIG. 2B, the duct **25*b* is also provided with an upper or upstream portion 27*b* of converging cross-section in the downstream direction but here the axially movable member 26*b* is formed with a converging lower end portion having an angle of convergence greater than the angle of convergence of the portion 27*b*. This arrangement provides that the point of maximum constriction in the duct 25*b* lies in a movable plane 28*b* which passes through the widest portion of the member 26*b* and intermediate the ends of the converging portion 27*b*. It will also be seen that, due to the differing angles of convergence of the member 26*b* and portion 27*b*, there is formed an annular section of diverging cross-section located in the duct 25*b* below the plane 28*b*. The duct 25*b* is also preferably formed with a portion 29*b* of diverging cross-section downstream of the converging portion 27*b* with respect to the direction of flow. While the planes 28*a* and 28*b*** are both shown as defined by sharp edges, it will be understood that these planes may have some thickness, on the order of about 0.1 inch, for example.

Returning to FIG. 1A, the member 26 and converging section 27 cooperate to define a throat to constrict the flow of intake air drawn through the duct 25 resulting in a significant increase in velocity of the intake air prior to its admission into the intake manifold 21. It will also be understood that during normal operation of the engine, the pressure in the intake manifold 21 is below atmospheric, i.e. a vacuum condition exists in the manifold. Generally this vacuum ranges between 6 and 24 inches of mercury vacuum depending on the engine speed and load conditions. The intake manifold vacuum may, however, fall below 6 inches Hg during rapid acceleration and may occasionally exceed 24 inches Hg. during rapid deceleration.

As the flow of intake air is constricted in the variable area throat zone between the member 26 and converging section 27, the air velocity at the throat constriction increases and the air pressure decreases. When the pressure at the constriction is at the critical pressure of 53% of atmospheric pressure, the flow of intake air at the constriction is at sonic velocity. Since the pressure at the constriction is always critical when the manifold pressure is equal to or less than the critical pressure, sonic velocity at the constriction is obtained at all manifold vacuum conditions above the threshold vacuum of 14.3 inches Hg. In other words, in the range of 14.3–24 inches of Hg. vacuum.

By gradually increasing the cross-sectional area of the intake air duct below the point of maximum constriction of the throat, i.e. below the variable area throat zone, a diffuser is formed. The cross-sectional area increases with distance from the throat constriction similar to that provided by a cone having an apex angle of about 6° to 18°, preferably 8° to 12°. Such a diffuser section is shown in exaggerated form in the embodiments illustrated in FIGS. 1B, 2A and 2B. The gradual increase in cross-sectional area provided by the diffuser section enables a substantial portion of the kinetic energy of the high velocity intake air to be recovered as static pressure and this substantially lowers the intake manifold vacuum unchoking point at which sonic velocity through the throat is still achieved. In addition, with an efficient diffuser section and sonic velocity at the throat, at all manifold vacuums above the unchoke point, the flow of intake air just downstream of the throat is accelerated to supersonic velocity and then the air passes through a shock zone as the velocity is abruptly reduced below sonic and the pressure returns to the pressure prevailing within the manifold. As will be described hereinafter, the liquid fuel and intake air mixing and modulating device of the present invention is effective to produce sonic velocity at the throat and supersonic velocity and a shock wave in the diffuser section over substantially the entire range of intake manifold vacuum conditions encountered in normal operation of the engine.

While the term diffuser is used herein as descriptive of the divergent section of gradually increasing cross-sectional area below the throat constriction, those skilled in the art will recognize that, technically speaking, the initial portion of this divergent section actually functions as a supersonic nozzle under the conditions just described. Thus, with reference to FIG. 1B, a supersonic zone 16 is provided immediately downstream from the throat zone 13, and the velocity of the air and fuel mixture is accelerated to supersonic velocity in the supersonic zone when the manifold vacuum is above the unchoke point. On the other hand, when the manifold vacuum is below the unchoke point, supersonic velocity no longer exists in zone 16. The supersonic zone 16 connects with a subsonic zone 17 in the gradually increasing cross sectional area 19 below the throat zone 13. The transition from supersonic to subsonic velocity produces a non-turbulent shock zone 18 when the manifold vacuum is above the unchoke point, and the fuel droplets are believed to be further subdivided and distributed throughout the air as they pass through the shock zone.

Pursuant to the present invention, liquid fuel is introduced substantially uniformly into the flow path of the intake air in a fuel delivery zone at or before the point of maximum constriction of the throat of the mixing and modulating device 20. As the intake air and fuel pass together through the fuel delivery zone and then through the throat constriction, or zone, the liquid fuel is finely divided and entrained in the high velocity intake air. Moreover, when the velocity of air at the throat is at sonic velocity, a substantial and useful portion of the finely divided fuel remains entrained in the intake air as it passes through the intake manifold and into the cylinders of the engine. With an efficient diffuser section, after the fuel is divided and entrained at the throat, the velocity of the intake air increases to a supersonic peak velocity in the diffuser section and then abruptly shocks down to subsonic velocity and the pressure condition prevailing generally in the intake manifold. This rapid rise and fall in intake air velocity subjects the larger entrained liquid fuel droplets to high shear forces in successive forward and reverse directions and breaks this fuel up into even finer droplet form than that previously formed in the fuel delivery and throat zones.

It has been found that an otherwise conventional gasoline engine fitted with the liquid fuel and intake air mixing and modulating device 20 of the present invention produces significantly lower levels of undesirable exhaust emissions than the same engine with its normal carburetor. For example, a 1963 Rambler American 220 with a six-cylinder inline engine of 197 cubic inch displacement and an 8.7:1 compression ratio was tested for exhaust emissions when equipped with its standard one barrel carburetor and when equipped with a liquid fuel and intake air mixing and modulating device of the present invention.

The car was tested on a standard Clayton chassis dynamometer with a normal road load effectively applied at the rear wheels of the car. Hydrocarbon exhaust emissions in parts per million were continuously monitored with a Beckman non-dispersive infra-red spectrometer sensitized to hexane. The percentage of free oxygen in the exhaust was also continuously monitored with a Beckman paramagnetic oxygen analyzer. The percentage of carbon monoxide in the exhaust was periodically spot checked with a Bacharach carbon monoxide analyzer. A modified Saltzman solution was used to periodically determine the oxides of nitrogen present in the exhaust in parts per million. A comparison of the exhaust emissions of the car with its regular carburetor and with the mixing and modulating device of the present invention is presented in Table I for operation of the car at both 30 and 50 mph. In each case, the figures presented represent the average of several test samples.

TABLE I

| | HC ppm | CO % | $NO_x$ ppm | $O_2$ % |
|---|---|---|---|---|
| | | Speed 30 MPH | | |
| Reg. Carb. | 360 | 0.10 | 1750 | 4.2 |
| Mixing & Mod. Device A | 35 | 0.27 | 395 | 6.2 |
| | | Speed 50 MPH | | |
| Reg. Carb. | 330 | 2.60 | 2500 | 1.5 |
| Mixing & Mod. Device A | 0* | 0.10 | 305 | 5.7 |

*Below the 30 ppm at which hydrocarbons could be reliably detected with the test instrument.

As can be seen from the above table, the undesirable emissions of HC, CO, and $NO_x$ were significantly reduced and the percentage of free oxygen in the exhaust was greatly increased during the 50 mph test when the car was equipped with the mixing and modulating device of the present invention. The levels of HC and $NO_x$ were also substantially reduced when the car was operated with the device of the present invention at 30 mph.

Figures 4, 5, 6, 8:
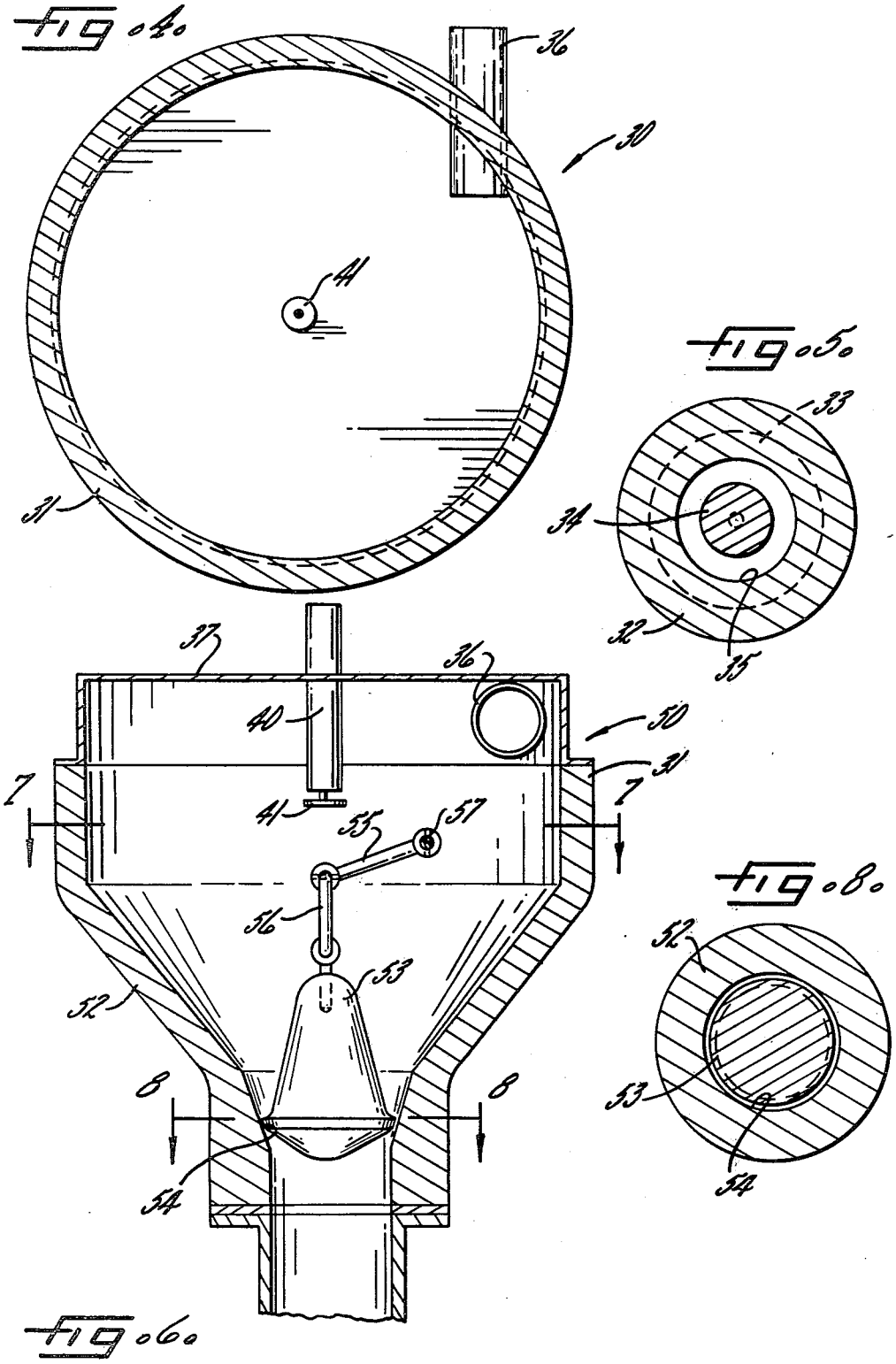
FIGS. 4 and 5 are cross-sections substantially as seen along lines 4—4 and 5—5, respectively, in FIG. 3.
FIG. 6 is a vertical cross-section similar to FIG. 3 of a modified form of the liquid fuel and intake air mixing and modulating device of the present invention.
FIGS. 7 and 8 are cross-sections substantially as seen along line 7—7 and 8—8, respectively, in FIG. 6.

The liquid fuel and intake air mixing device A of the present invention which was used on the Rambler car engine for the above tests is illustrated in more detail in FIGS. 3–5. As shown here, the device A, generally indicated at 30, includes an intake air duct 31 having a portion 32 converging in the downstream direction with respect to the flow of intake air. To constrict or throttle the flow of intake air through the portion 32 an axially movable throat modulator 33 is disposed coaxially in the duct 31. The modulator 33 is formed with a converging lower end portion 34 which together with the lower end of the converging portion 32 form a throat in the form of a variable area annular orifice 35 (see FIG. 5).

Intake air is drawn into the duct 31 through an intake conduit 36 which projects tangentially through a cover 37 over the large end of the duct. The intake air then flows through the duct and the converging portion 32 where the flow is constricted by the modulator 33 to substantially increase the velocity of the intake air prior to its passing through a discharge conduit 38 and into the intake manifold of the engine. It will also be noted that the duct 31 includes a diverging portion 39 located downstream of the point of maximum constriction on throat 35 and in this regard the arrangement of the device 30 is generally similar to that schematically illustrated in FIG. 2A.

Liquid fuel is supplied to the mixing and modulating device 30 illustrated in FIGS. 3–5 by means of a fuel nozzle 40. In the illustrated embodiment, the fuel nozzle 40 projects axially into the duct 31 through the cover 37 and the discharge end of the nozzle is centered in the duct well above the point of maximum constriction of the throat. The liquid fuel is preferably sprayed into the duct 31 from the discharge end of the nozzle in a substantially symmetrical pattern. To this end, the illustrated nozzle 40 is of the air aspirating type and includes a baffle 41 located at right angles to the discharge end of the nozzle to symmetrically distribute the liquid fuel in a generally radial direction. For the tests tabulated above, the nozzle was supplied with air under pressure of about 40 psi and the flow of fuel through the nozzle was regulated by a valve (not shown).

To insure that the liquid fuel is introduced substantially symmetrically into the path of the high velocity intake air flowing through the constricted throat 35, the duct 31 and throat 35 are preferably mounted with their axes oriented substantially vertically. With this arrangement, the liquid fuel, which is sprayed from the nozzle 40 and reaches the inner wall of the duct 31, runs down the sloping wall of the converging portion in a generally uniform manner to the point of maximum constriction or throat 35 defined between the portion 32 and the modulator 33. At or before the point of maximum constriction (represented by the section line 5—5 in FIG. 3) the high velocity air strips the liquid fuel film from the wall and finely divides and entrains the fuel in the intake air.

For controlling the degree of constriction at the throat and thus modulating the flow of intake air therethrough the modulator 33 is axially movable. In the embodiment illustrated in FIG. 3, the modulator 33 is mounted on a control rod 45 threadably received in a boss 46 formed on the discharge conduit 38. A knurled knob 47 is provided on the lower end of the rod 45 for conveniently turning the rod to raise or lower the modulator 33 relative to the throat 35 and thus increase or decrease the area of the annular orifice.

Figure 7:
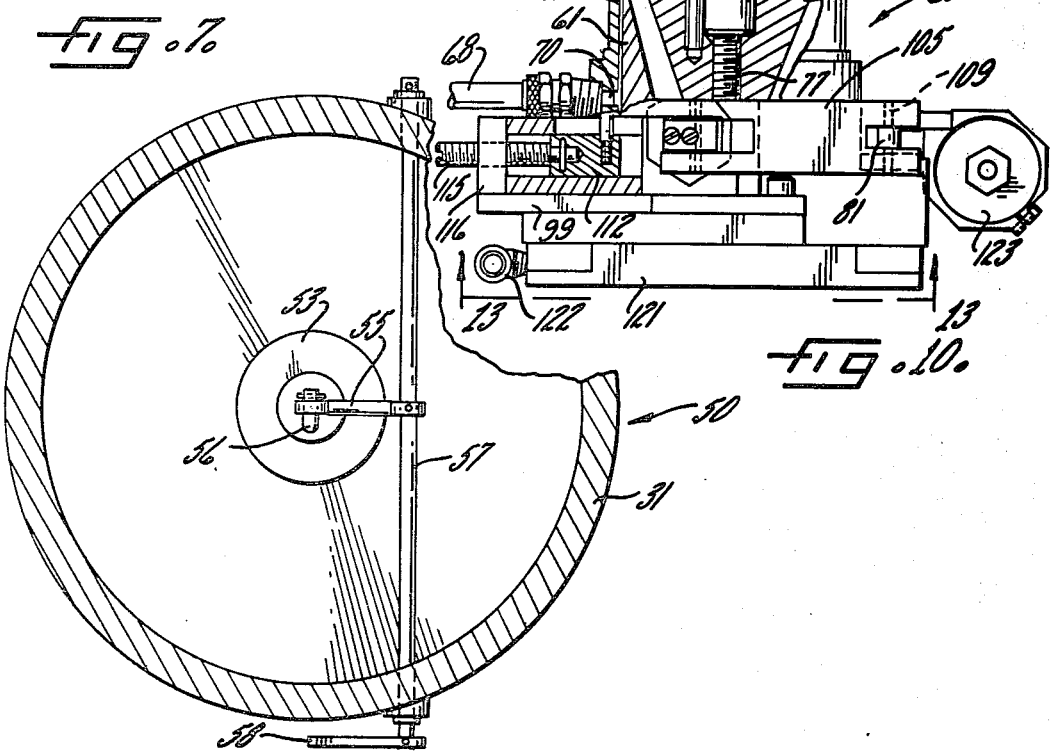

Another embodiment of the mixing and modulating device B of the present invention is illustrated in FIGS. 6–8. In general this device B indicated generally at 50 is similar to the device A illustrated in FIGS. 3–5 and like reference numerals have been used to indicate the duct 31, the cover 37, the tangential intake passage 36 and the fuel nozzle 40. It will be noted, however, that the converging portion 52 and the modulator 53 of this embodiment follow the schematic arrangement shown in FIG. 2B rather than that shown in FIG. 2A. In other words, the throat or point of maximum constriction, in the form of an annular orifice 54 defined between the converging portion 52 and modulator 53 is not at a fixed location as in the FIG. 3 embodiment, but rather is located in a movable plane (represented by the section line 8—8 in FIG. 6) which passes through the widest portion of the tapered lower end of the modulator 53.

It will also be noted that the mixing and modulating device 50 shown in FIGS. 6–8 employs a different means for raising and lowering the modulator 53 in the throat 54 than the device 30 shown in FIG. 3. Here, the raising and lowering means is in the form of a crank arm 55 from which the modulator 53 is suspended by a link 56. The crank arm 55 is carried on a cross shaft 57 projecting through the duct 31 and another crank arm 58 at one end of the cross shaft is provided for regulating the movement of the modulator 53. This arrangement not only permits more convenient control of the movement of the modulator 53, but also, permits the modulator position control linkage to be coupled to the fuel control valve (not shown) in order to coordinate the quantities of both liquid fuel and intake air introduced into the engine.

A liquid fuel and intake air mixing and modulating device B of the type illustrated in FIGS. 6–8 was also tested on the 1963 Rambler automobile discussed above. The results of these tests, which again represent the averages of several samples, are presented below in Table II.

TABLE II

| 1963 Rambler 220 with Mixing and Modulating Device B | | | | |
|---|---|---|---|---|
| Speed | HC ppm | CO % | $NO_x$ ppm | $O_2$ % |
| 15 | 30 | 0.10* | 15 | 6.8 |
| 20 | 0* | 0.10** | 10 | 5.8 |
| 35 | 0 | 0.10* | 58 | 5.6 |
| 45 | 0 | 0.10* | 170 | 5.8 |

*Below the 30 ppm at which hydrocarbons could be reliably detected with the test instrument.
**The CO values all fell between 0.05 and 0.15%.

Since the speeds at which the car was tested when equipped with the B type mixing and modulating device 50 illustrated in FIGS. 6–8 were not the same as the tests of the A type device 30 illustrated in FIGS. 3–5, a direct comparison of the results cannot be made. However, it will be observed that, in general the exhaust emissions for the engine with the B type device 50 were even lower than the ones with the A type device 30.

As a further test of the B type device 50, it was compared with the Rambler when equipped with its regular carburetor at 35 mph. and with the dynamometer adjusted to apply approximately 20 road horsepower at the rear wheels of the car to simulate a power run. The results of this test are presented in Table III which further illustrates the significant reductions in undesirable exhaust emissions with the use of the present invention.

TABLE III

| 1963 Rambler at-35 MPH and 20 road load hp | | | | |
|---|---|---|---|---|
| | HC ppm | CO % | $NO_x$ ppm | $O_2$ % |
| Reg. Carb. | 120 | 0.49 | 3360 | 4.0 |

TABLE III-continued

| | 1963 Rambler at 35 MPH and 20 road load hp | | | |
|---|---|---|---|---|
| | HC ppm | CO % | $NO_x$ ppm | $O_2$ % |
| Mixing & Mod. Device B | 0* | 0.15 | 650 | 6.2 |

*Below the 30 ppm at which hydrocarbons could be reliably detected with the test instrument.

The reason that the liquid fuel and intake air mixing and modulating device of the present invention produces such significant reductions in the undesirable exhaust emissions is due primarily to two correlated factors, namely, the nature and the uniformity of the entrained fuel and intake air mixture produced by the device. First, by finely dividing, throughly mixing and substantially completely entraining the liquid fuel in the intake air, an essentially uniform air-fuel mixture is delivered to each cylinder on every cycle. The nature and uniformity of this air-fuel mixture greatly reduces the cylinder to cylinder and cycle to cycle variations that tend to produce misfires and incomplete combustion in conventional carburetor systems. As a consequence, the air-fuel mixture which may be utilized in the present invention is substantially leaner than those heretofore employed.

It is, of course, well known that theoretically complete combustion should occur at a stoichiometric air-fuel ratio, namely 15.5:1. It is also well understood that in practice this theoretically ideal condition does not exist in the cylinders of a conventionally equipped engine and that as a consequence carburetors in the past have been set to deliver air-fuel mixtures richer than stoichiometric. However, at such rich air-fuel ratios complete combustion cannot take place and substantial emissions of unburned hydrocarbons and carbon monoxide occur. Also, because the combustion is incomplete with these fuel rich mixtures and because of the excess fuel in the engine cylinders, the final temperature of combustion is lower than when the fuel and air are burned at the stoichiometric ratio. This, in turn, tends to reduce the production of the oxides of nitrogen since their formation is promoted by high combustion temperatures.

In order to decrease the production of unburned hydrocarbons and carbon monoxide, carburetors have recently been set to provide air-fuel mixtures close to or slightly greater than the stoichiometric ratio. While this has been effective to reduce hydrocarbon and carbon monoxide emissions due to more complete combustion of the air-fuel mixture it has also increased the production of the oxides of nitrogen as a result of the higher combustion temperatures. In fact, it has been found that production of the oxides of nitrogen are highest at slightly leaner than stoichiometric air-fuel ratios.

It is one important aspect of the present invention that due to the nature and greatly improved uniformity of the air-fuel mixture produced by the instant devices, the engine can be run on air-fuel mixtures much leaner than stoichiometric without misfiring which usually results from intermittently exceeding the lean limits of the air-fuel ratio on a cylinder to cylinder or cycle to cycle basis. An air-fuel ratio of 20:1 provides approximately 30% more oxygen for combustion than is available at the stoichiometric ratio. Thus, even when complete combustion of the fuel takes place, the exhaust gas will contain about 5% free oxygen. Significantly, this free oxygen, with its associated quota of nitrogen, has been found to be associated with a reduction in the peak combustion temperature and a reduction in the formation of the oxides of nitrogen. In this connection, it will be recalled that one of the exhaust emission control measures in current use today involves injecting free air into the exhaust manifold. The present invention, however, differs from these arrangements in a very important respect. Here, the excess oxygen is introduced with the fuel as a result of using an air-fuel ratio on the order of 20:1 and, thus excess oxygen is present and available during the entire combustion process.

Turning now to the second important factor of the invention, i.e., the nature of the air-fuel mixture, it is believed that it plays an equal, if not greater, role in the reduction of undesirable exhaust emissions from engines utilizing the present devices.

By bringing the fuel into contact with the high velocity intake air passing through the constricted throat of the mixing and modulating device, the liquid fuel is broken up into finely divided droplets and entrained in the intake air. It has also been found that vaporization of the entrained fuel in the manifold is to be avoided to the extent practical. This can be achieved by decreasing the heat supplied to the manifold by such methods as blocking the heat riser, using a lower temperature thermostat and insulating the manifold. This leads to significant improvements over present air-fuel induction systems which require a high degree of fuel vaporization in order to achieve reasonable results.

Because in the present invention, the fuel need not be vaporized outside the engine cylinders, the air-fuel mixture delivered to the cylinders can be cooler, and is more dense for this reason, and also it is more dense because the finely divided liquid fuel displaces less volume than does vaporized fuel. It will be appreciated, of course, that a denser air-fuel charge produces more power than a less dense one. Thus, the power output of the engine is increased from this factor.

The temperature of the air-fuel charge at the end of compression in the present invention is also lower than that in conventional engines which depend upon heating the intake air to vaporize the fuel. In part, the lower final compression temperature in the present invention is due to the lower temperature of the air-fuel mixture initially drawn into the cylinders as explained above. However, the final compression temperature in the present invention is further reduced by virtue of the use of some of the heat of compression to vaporize fuel within the cylinders. Moreover, since the final compression temperature is lower, the combustion temperature will also be lower in the present invention as compared to conventional systems. As noted above, less oxides of nitrogen are produced at lower combustion temperatures.

The lower compression temperature also appears to have a bearing on the octane requirement of the fuel for a given engine. Since the compression temperature is lower, the air-fuel charge for an engine of a given compression ratio is less likely to self-ignite. Thus, the same fuel can be used in higher compression ratio engines or a lower octane fuel can be used in a given compression ratio engine. The latter, of course, permits a savings in fuel costs because the lower octane fuel is normally sold at a price below that of the higher octane "premium" fuel.

The nature of the air-fuel charge of the present invention is also believed to result in lowering the octane requirement of the fuel. Apparently, this stems from a modification of the combustion process resulting from the air-fuel charge as formed by the mixing and modulating device of the present invention. It has been found, for example, that, in a 1963 Buick V-8 engine of 215 cubic inch displacement having a 11:1 compression ratio, the present invention produces excellent results both in terms of power and low exhaust emissions on unleaded regular gasoline of about 84–86 octane rating as well as regular grade leaded gasoline of about 91–92 octane rating. On the other hand, this engine when equipped with its regular 4-barrel carburetor required leaded premium grade gasoline of about 98–100 octane rating.

The results of the tests on the high compression 1963 Buick V-8 engines comparing the regular carburetor with the type B mixing and modulating device 50 of the present invention are presented below in Table IV. Again the same test equipment and procedures as used with the Rambler were employed.

TABLE IV

IDLE

| | Fuel | HC ppm | CO % | $NO_x$ ppm | $O_2$ % |
|---|---|---|---|---|---|
| Reg. Carb. | Premium | 310 | 3.6 | 60 | 1.3 |
| Mixing & Mod. Device B | Regular | 120 | 0.15 | 11 | 4.6 |
| | Unleaded | 30 | 0.15 | 0 | 4.7 |

35 MPH

| | Fuel | HC ppm | CO % | $NO_x$ ppm | $O_2$ % | A/F | MPG |
|---|---|---|---|---|---|---|---|
| Reg. Carb. | Premium | 350 | 0.40 | 1200 | 2.2 | 12.5/1 | 21.6 |
| Mixing & Mod. Device B | Regular | 0* | 0.15 | 15 | 6.8 | 24.2/1 | 25.5 |
| | Unleaded | 15 | 0.15 | 35 | 5.4 | 23.6/1 | 19.0 |

45 MPH

| | Fuel | HC ppm | CO % | $NO_x$ ppm | $O_2$ % | A/F | MPG |
|---|---|---|---|---|---|---|---|
| Reg. Carb. | Premium | 300 | 1.20 | 1450 | 1.6 | 12.5/1 | 18.0 |
| Mixing & Mod. Device B | Regular | 0* | 0.15 | 135 | 8.5 | 25.2/1 | 21.5 |
| | Unleaded | 0* | 0.15 | 180 | 5.0 | 23.2/1 | 21.5 |

*Below the 30 ppm at which hydrocarbons could be reliably detected with the test instrument.

From Table IV, it will again be seen that significant reductions in exhaust emissions result from the use of the present invention. It will also be noted from the 35 and 45 mph tests that mixing and modulating device of the present invention allows the engine to operate at significantly higher air-fuel ratios and with somewhat lower fuel consumption.

After noting the foregoing results, the Buick engine as equipped with the type B device was run at 40 mph with normal road load and the air-fuel ratio was further increased. These results are shown in Table V and further confirm the improvement in engine efficiency and its ability to run on unleaded gasoline as well as the reduction in exhaust emissions.

TABLE V

| | Fuel | HC ppm | CO % | $NO_x$ ppm | $O_2$ % | A/F | MPG |
|---|---|---|---|---|---|---|---|
| Mixing & Mod. Unit B | Regular | 15 | 0.07 | 70 | 11.2 | 27.8/1 | 32.6 |
| | Unleaded | 0* | 0.05 | 260 | 12.1 | 31.2/1 | 37.7 |

*Below the 30 ppm at which hydrocarbons could be reliably detected with the test instrument.

In all of the foregoing tests, the fuel was introduced into the device as a spray through the nozzle 40 with approximately 40 psi air pressure used to aspirate the fuel from the nozzle. It has been found, however, that it is not essential that the fuel be sprayed into the device. As shown below in Table VI the Buick engine was also tested with approximately 20 hp applied at the rear wheels to further explore the efficiency of the present invention.

TABLE VI

| | Fuel | HC ppm | CO % | $NO_x$ ppm | $O_2$ % | Power hp. |
|---|---|---|---|---|---|---|
| Reg. Carb. | Premium | 180 | 1.1 | 2200 | 2.0 | 24 |
| Device B 40 psi air | Regular | 0 | 0.15 | 1020 | 7.0 | 23 |
| without air | Regular | 15 | 0.15 | 270 | 6.9 | 23 |

Actually, under power conditions the B type device without air pressure at the nozzle reduced the production of oxides of nitrogen compared to when the nozzle was supplied with air pressure.

This latter circumstance prompted the design of the liquid fuel and intake air mixing and modulating device C illustrated in FIGS. 9–13 of the drawings. Referring first to FIG. 11, it will be seen that this embodiment of the device C, indicated generally at 60, like the two previously described embodiments 20 and 30, includes a throat insert 61 defining a converging portion 62 and a modulator element 63 between which there is defined a throat in the form of an annular orifice 65. As shown in FIG. 11 the modulator 63 is in its uppermost position in the insert 61 and the orifice 65 has its greatest cross-sectional area.

The modulator 63 is provided with a lower converging end portion 64 which has an angle of convergence more than the angle of convergence of the portion 62. In the illustrated embodiment, the respective angles of convergence of the modulator 63 and of the portion 62 are 44° and 28°. As previously explained, these two elements thus define a diffuser section to convert a substantial portion of the kinetic energy of the high velocity air to static energy thus permitting sonic air velocity through the orifice over an extended range of intake manifold vacuum conditions. The throat insert 61 is also formed with a diverging lower end portion 66 to further extend the length of the diffuser section. The similarity of this arrangement with that schematically illustrated in FIG. 2B will also be apparent in view of the maximum throat constriction between the throat insert 61 and modulator 63 being located in a movable plane.

Liquid fuel is supplied to the device 60 through a conduit 68 connected to an annular body 69 in which the throat insert 61 is mounted. The body 69 is formed with an annular groove 70 communicating with the conduit 68 (see FIGS. 9 and 10) to distribute the fuel around the outside of the insert 61. Above the groove 70, the body 69 is formed with an enlarged bore providing a clearance space 71 between the body 69 and the insert 61. The fuel flows from the groove 70 up through the annular clearance space 71 and over a lip 72 at the upper end of the throat insert 61.

With the modulator in its uppermost position as shown in FIG. 11, the fuel flowing over the lip 72 is immediately subjected to the high velocity intake air flowing through the constricted orifice 65. The high velocity air strips the liquid fuel from the wall and entrains it in finely divided form in the intake air. The velocity of the intake air is then reduced substantially as it passes through the diffuser section of the device 60 and into the intake manifold such that a substantial and useful portion of the finely divided fuel remains entrained in the intake air as it passes into the engine cylinders.

Figure 9:
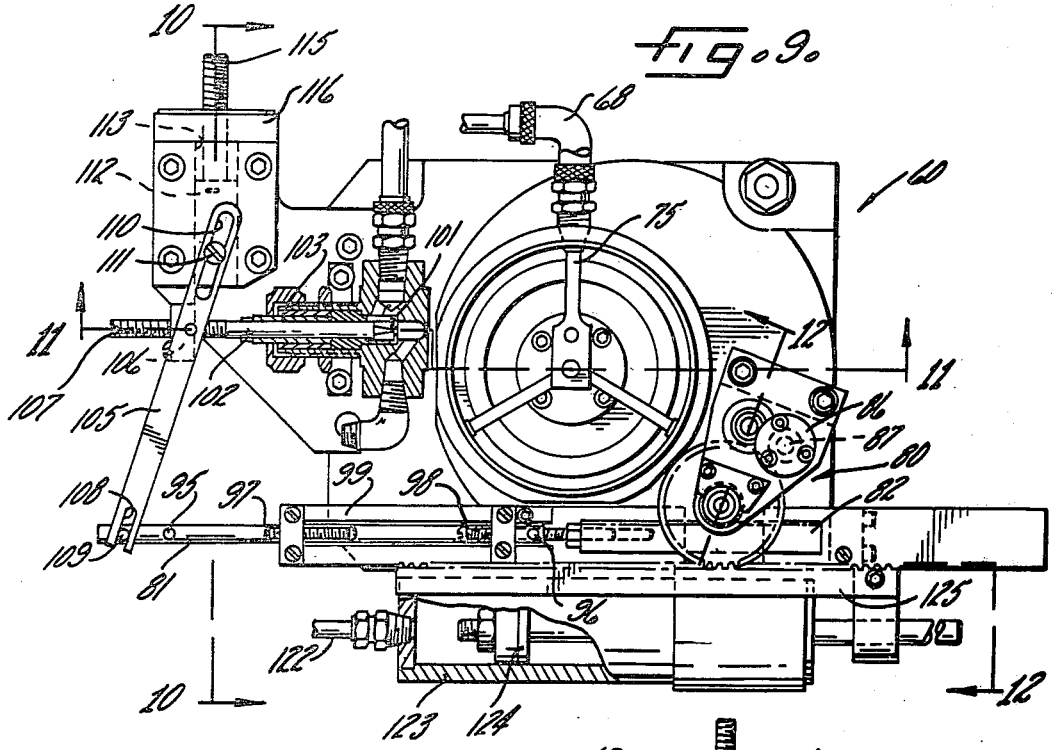
FIG. 9 is a plan view, with certain portions in sections, of another form of the liquid fuel and intake air mixing and modulating device of the present invention.
Figure 10:
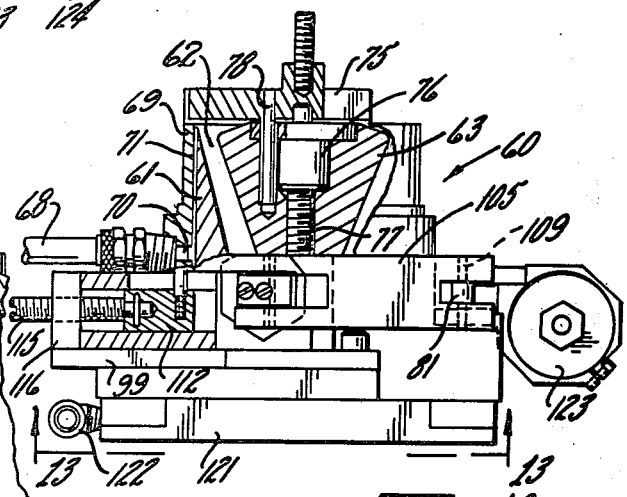
FIG. 10 is a front elevation, partially in section, of the device shown in FIG. 9.
Figure 12:
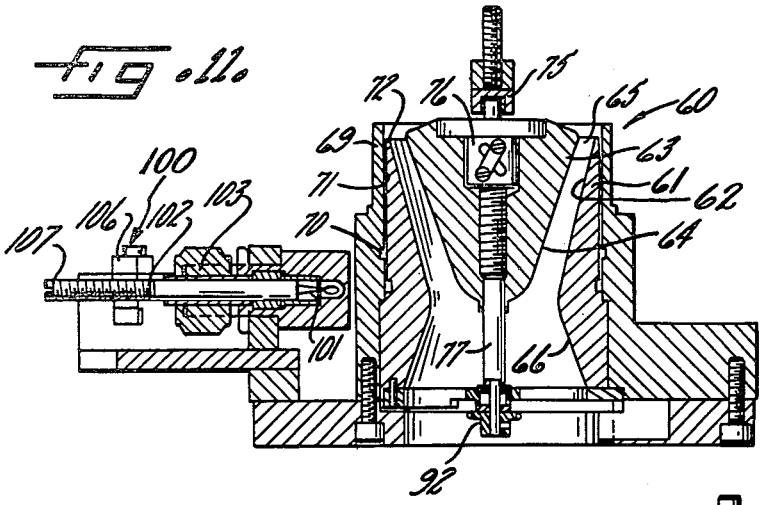
Figure 12:
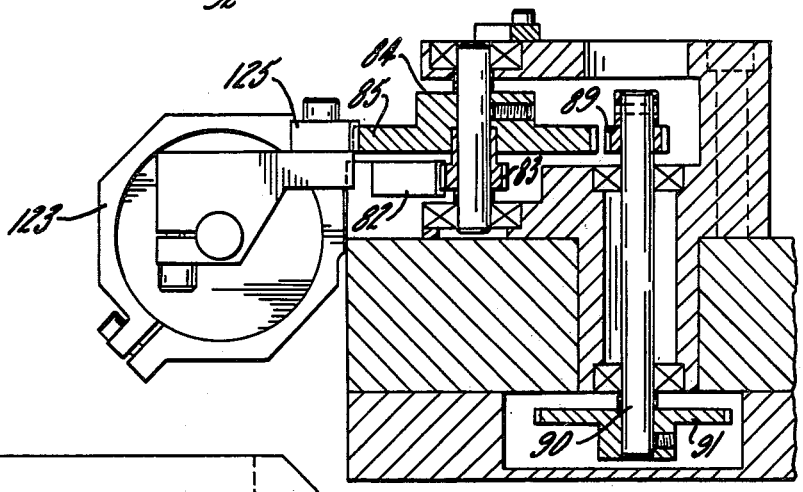
Figure 13:
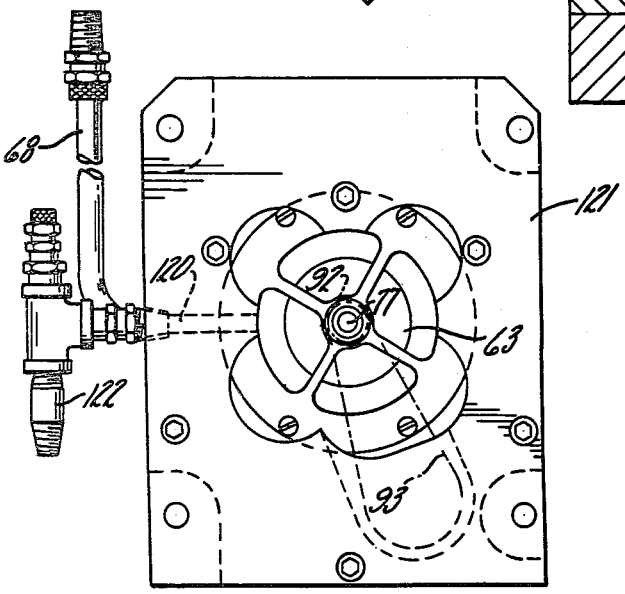
FIG. 13 is a view of the bottom of the device shown in FIG. 9.

To regulate the degree of restriction of the annular orifice 65, the modulator 63 is mounted for axial movement in the throat insert 61. As seen in FIGS. 9–11 the modulator 63 is centered in the throat insert 61 by a web 75 connected to the upper end of the body 69. The modulator carries a ball bearing type nut 76 which receives the threaded end of an operating rod 77. Rotation of the modulator 63 is prevented by a pin 78 extending downwardly from the web 75 into an opening in the upper portion of the modulator. As the rod 77 is rotated, the ball nut 76 causes the modulator 63 to move up or down, depending on the direction of rotation of the rod, thus changing the cross-sectional area of the annular orifice 65.

In the illustrated embodiment, rotation of the rod 77 is effected by a rack and pinion mechanism indicated generally at 80. As seen in FIG. 9, a reciprocating control link 81 is fitted with a rack portion 82 at one end. The rack 82 engages a pinion gear 83 mounted on a shaft 84 journalled in bearing in the body 69 of the mechanism 80. The shaft carries another gear 85 that meshes with a gear 86 on another shaft 87. Another gear 88 on shaft 87 in turn meshes with a gear 89 on a shaft 90 the lower end of which carries a sprocket 91 (see FIG. 12). The lower end of the control rod 77 also carries a sprocket 92 which is coupled to the sprocket 91 by a suitable chain 93 (see FIG. 13). As the control link 81 is moved to the right in FIG. 9, the modulator 63 is moved down as seen in FIG. 11 and vice versa. The maximum upper and lower positions of the modulator are adjustably fixed by means of pins 95 and 96 on the link which abut set screws 97 and 98 on the framework 99 of the device 60.

Figure 16:
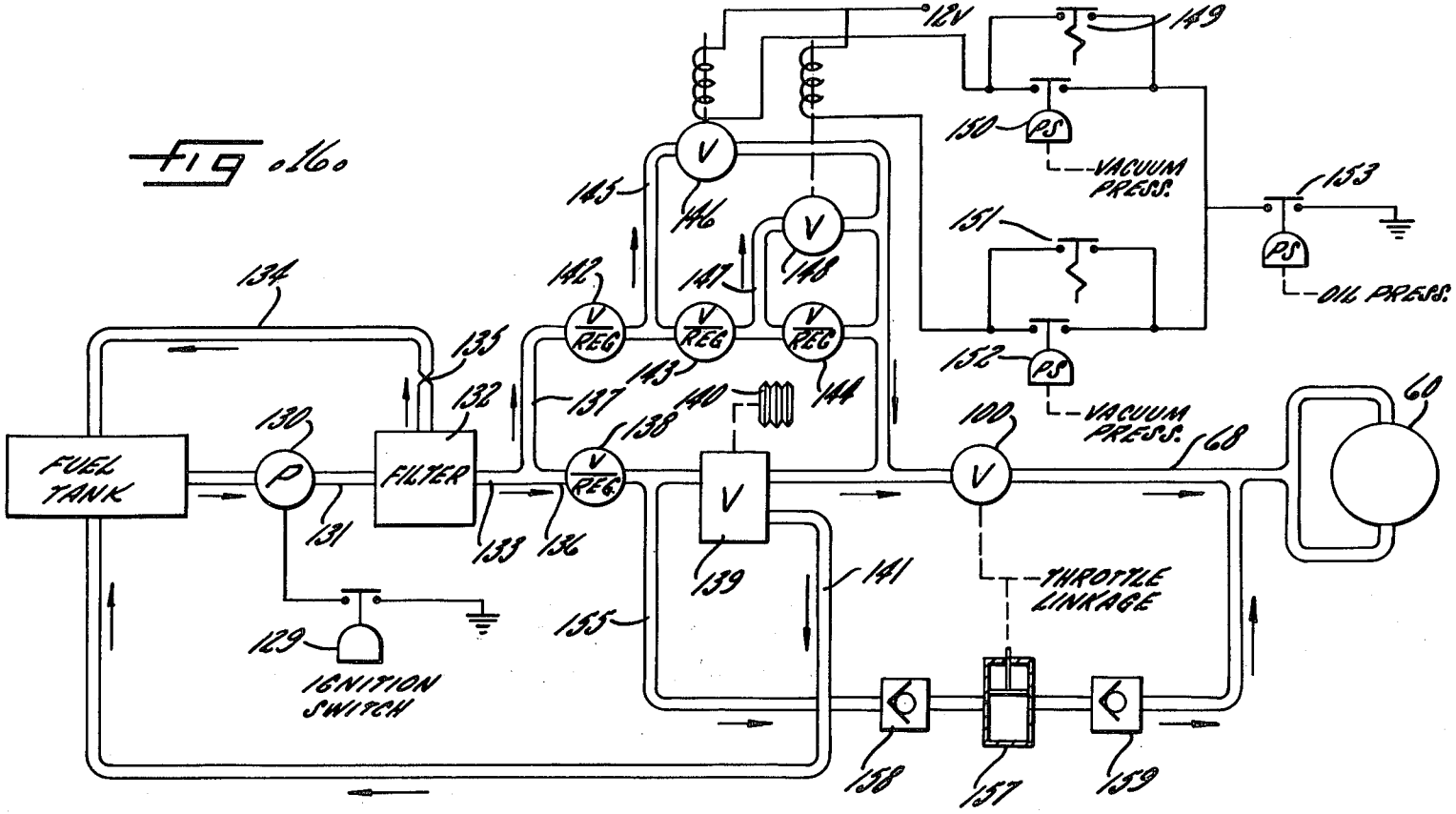
FIG. 16 is a schematic diagram of the fuel supply system of the present invention.

Control of the fuel admitted to the device 60 is also coordinated with the constriction in the throat insert 61 by the modulator 63. To this end, the fuel is supplied under pressure by a pump 130 (FIG. 16) to a fuel regulating valve 100 connecting the supply line 68 to the body 69 of the device. The valve 100 includes a metering orifice 101 and a tapered needle 102 which regulates the flow of fuel through the orifice. The needle is reciprocally mounted in a packing gland 103 of valve 100.

Coordination of the valve 100 with the modulator 63 is achieved through a link 105 interconnecting the operating link 81 and the valve needle 102. The link 105 is pinned intermediate its ends to a block 106 which receives the threaded end 107 of the needle. At one end the link 105 is provided with a slot 108 which receives a pin 109 on the control link 81 and at the other end the link has a slot 110 which receives a pin 111 secured in a block 112 reciprocally mounted in a guide channel 113 defined in a portion of the frame 99. As the control rod is shifted to the right in FIG. 9, the link 105 rotates about pin 111 and moves the needle valve 102 to the right, decreasing the opening through the metering orifice 101.

To adjust the fuel flow for a given setting of the modulator, the threaded end 107 of the needle can be screwed in or out of the block 106 to decrease or increase the fuel flow through the orifice 101. The rate of change of fuel flow with changes in the position of the modulator may also be effected by changing the location of the pivot pin 111 about which the link 105 swings. This is accomplished by turning a screw 115 which is carried by the slide 112 and threadedly received in an end plate 116 of the frame 99. By changing the pivot point of the link 105 the amount of movement of the needle 102 is changed relative to the control link 81.

To compensate for the vacuum in the intake manifold which tends to draw the modulator 63 down into the throat insert 61, the device 60 is provided with a vacuum feedback means. A vacuum port 120 is located in the base 121 of the unit and a vacuum line 122 connects the port to a cylinder 123. A piston 124 in the cylinder carries a rack 125 engageable with the gear 85. As the vacuum at the port 120 increases, the piston 124 moves the rack 125 in a direction to lift the modulator 63 and thereby reduces the vacuum. This permits a much lower force to be applied to the control link 81 to adjust the position of the modulator 63.

The mixing and modulating device 60 illustrated in FIGS. 9–13 has been successfully applied to the engine of a 1970 Ford Torino. This engine has a displacement of 351 cu. in. and a 10.7:1 compression ratio. It includes a four-barrel carburetor as standard equipment and premium grade fuel is recommended.

The same test equipment and procedure described above in connection with the Rambler and Buick engines was employed with the Ford engine and the results are summarized in Table VII.

TABLE VII

| | Fuel | Octane | HC ppm | CO % | $NO_x$ ppm | $O_2$ % |
|---|---|---|---|---|---|---|
| | | IDLE | | | | |
| Reg. Carb. | Premium | 98 | 300 | 4.25 | 25 | 0 |
| Mixing & Mod. | Regular | 92 | 48 | 0.68 | —* | 6.0 |
| Device C | Unleaded | 87 | 15 | 0.50 | —* | 4.6 |
| | | 45 MPH | | | | |
| Reg. Carb. | Premium | 98 | 170 | 0.45 | 2600 | 0.7 |
| Mixing & Mod. | Regular | 92 | 30 | 0.25 | 480 | 6.5 |
| Device C | Unleaded | 87 | 15 | —* | 220 | 7.0 |
| Device C | White gas | 58 | 15 | 0.30 | 40 | 7.0 |

*No reading taken.

The results presented in Table VII again demonstrated the significant reduction in exhaust emissions achieved by use of the liquid fuel and intake air mixing and modulating device and method of the present invention. At the same time the octane requirement of the engine is substantially reduced and the fuel economy is improved.

In order to permit simultaneous testing of additional automobiles on the road as well as on the dynamometer, several more liquid fuel and intake air mixing and modulating devices were built. Also, a new chassis dynamometer stand together with more sensitive continuous recording instrumentation was installed at the test facility.

These additional mixing and modulating devices D are essentially the same as the one shown in FIGS. 9–13 except that the throat insert 61*d* and the modulator 63*d* were fabricated to function in accordance with the design schematically shown in FIG. 2A. In other words, the throat or point of maximum constriction, in the form of an annular orifice 65*d* defined between the throat insert 61*d* and modulator 63*d*, is located in a fixed plane, represented by section line 15—15 in FIG. 14. In the illustrated embodiment the angle of convergence of the modulator is 30° and that for the throat insert 61*d* is 100° above the orifice 65*d* and 10° below the orifice. Thus, it will be seen that the throat insert 61*d* and the modulator 63*d* cooperate to form a diffuser section of gradually increasing cross-sectional area downstream of the throat.

One of these mixing and modulating devices D with a 1.92 inch diameter throat was installed on a 1970 Dodge automobile with a 318 cubic inch displacement engine having an 8.8:1 compression ratio. The improvement in exhaust emissions of this combination, and its ability to tolerate low octane unleaded fuel and even kerosene, as compared to the engine equipped with its standard carburetor is shown in Table VIII.

TABLE VIII

| | Fuel | 50 MPH HC ppm | CO % | $NO_x$ ppm |
|---|---|---|---|---|
| Reg. Carb. | | 100 | 0.20 | 3800 |
| Mixing & | 87 Octane | 35 | 0.20 | 270 |
| Mod. | 65 Octane | 25 | 0.06 | 170 |
| Device D | 65 Octane | 35 | 0.10 | 120 |
| Device D | Kerosene | 90 | 0.14 | 225 |

Similar results were also obtained with one of the mixing and modulating devices D having a 2.21 inch diameter throat installed on a 1970 Chevrolet having a 350 cubic inch V-8 engine with a 10.25:1 compression ratio. As originally equipped, this engine has a four-barrel carburetor and requires premium grade fuel. A comparison of the exhaust emissions produced by this engine with its normal carburetor and with the mixing and modulating device D of the present invention is presented in Table IX.

TABLE IX

| | Fuel | HC ppm | CO % | $NO_x$ ppm |
|---|---|---|---|---|
| | | IDLE | | |
| Reg. Carb. | Premium | 200 | 3.0 | 100 |
| Mixing & | Unleaded | 55 | 0.12 | 73 |
| Mod. | Regular | | | |
| Device D | | | | |
| | | 50 MPH | | |
| Reg. Carb. | Premium | 100 | 0.20 | 3800 |
| Mixing & | Unleaded | 35 | 0.20 | 270 |
| Mod. | Regular | | | |
| Device D | | | | |

Further tests were also conducted with the mixing and modulating device D installed on the engine of a 1958 Cadillac having a 365 cubic inch displacement and a 10.25:1 compression ratio. The results of these tests are summarized in Table X.

TABLE X

| | Fuel | HC ppm | CO % | $NO_x$ ppm |
|---|---|---|---|---|
| | | IDLE | | |
| Reg. Carb. | Premium | 500 | 2.5 | 80 |
| Mixing & | Unleaded | 118 | 0.10 | 40 |
| Mod. | Regular | | | |
| Device D | | | | |
| | | 50 MPH | | |
| Reg. Carb. | Premium | 100 | 1.2 | 1800 |
| Mixing & | Unleaded | 16 | 0.12 | 168 |
| Mod. | Regular | | | |
| Device D | | | | |

Again, the liquid fuel and intake air mixing and modulating device D of the present invention produced a substantial reduction in exhaust emissions and also permitted operation of the engine on lead-free regular grade gasoline.

It should be appreciated that the data presented in Tables 1-X was obtained during substantially steady state conditions. However, the liquid fuel and intake air mixing and modulating device of the present invention has also been found to provide substantial reductions in exhaust pollutants when operated pursuant to the current seven-mode cycle test. (See Fed. Reg. Vol. 33, No. 108, June 4, 1968) Basically, this test requires closely controlled operation of the engine on the dynamometer at certain specified speeds during specified time intervals. The exhaust emissions produced during the seven-mode cycle are then computed according to a weighted formula. Although the seven-mode cycle tests prescribed by the Federal Regulations require a cold start after at least a 12 hour waiting period, the test results presented hereinafter are "Hot Cycles" conducted without the engine returning to ambient temperature. In all of the seven-mode cycle tests reported herein, the heat cross-over in the intake manifold was blocked to reduce the intake manifold temperature.

Figure 14:
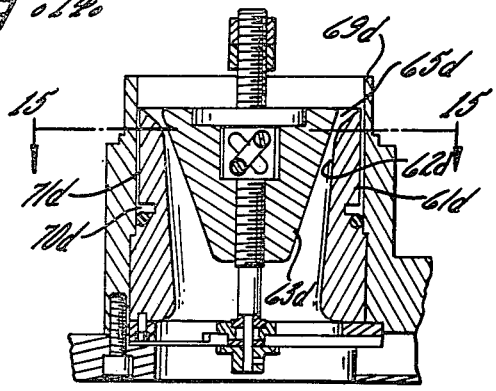
FIG. 14 is a vertical cross-section, similar to FIG. 11, of an alternative embodiment of the present invention.
Figure 15:
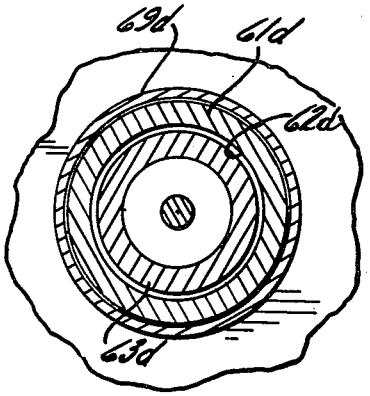
FIG. 15 is a section substantially as seen along line 15—15 in FIG. 14.

One of the liquid fuel and intake air mixing and modulating devices D having a throat and modulator as shown in FIGS. 14 and 15 was installed on the 1970 Chevrolet engine mentioned above and was operated pursuant to the foregoing seven-mode hot cycle test. Before presenting the results of these tests, it should be noted that changes in ignition timing of this engine (as well as most others) has a significant influence on the emission results under the seven-mode cycle test. As normally equipped, this engine has a transmission controlled vacuum actuated advance mechanism coupled to the distributor (spark ignition device) which advances the ignition timing up to 35°–40° before top dead center (BTDC) of the pistons at cruising conditions in high gear. When the vacuum advance mechanism is deactivated, the ignition timing is varied with engine speed by a centrifugal advance mechanism between 4° BTDC at idle and 20° BTDC at 50 mph. As shown in Table XI deactivating the vacuum advance mechanism results in cutting the HC and $NO_x$ emissions approximately in half during the seven-mode hot cycle tests when the engine is equipped with its standard four barrel carburetor.

TABLE XI

| | Fuel | Seven-Mode Hot Cycles Vac. Adv. | HC ppm | CO % | $NO_x$ |
|---|---|---|---|---|---|
| Reg. Carb. | Premium | Yes | 118 | 0.19 | 1147 |
| Reg. Carb. | Premium | No | 66 | 0.23 | 411 |

TABLE XI-continued

| | Seven-Mode Hot Cycles | | | | |
|---|---|---|---|---|---|
| | Fuel | Vac. Adv. | HC ppm | CO % | $NO_x$ |
| Reg. Carb. | Lead Free | Yes | 111 | 0.22 | 1039 |
| Reg. Carb. | Lead Free | No | 68 | 0.27 | 434 |

Substantial improvements in the above results were achieved when the Chevrolet engine was equipped with a mixing and modulating device D of the type shown in FIGS. 14 and 15 as may be seen in Table XII.

TABLE XII

| | Seven-Mode Hot Cycles | | | | |
|---|---|---|---|---|---|
| | Fuel | Timing | HC ppm | CO % | $NO_x$ |
| Mixing & Mod. Device D | Reg. Unleaded | 4°-14° | 33 | 0.18 | 180 |

It was noted during both road testing and dynamometer testing of the 1970 Chevrolet with the mixing and modulating device of the present invention that it was quite sensitive to changes in engine temperature and intake manifold vacuum conditions. In order to compensate for these changing conditions and to achieve the results of the seven-mode cycle tests presented above, a more elaborate fuel control system than had been used on the foregoing steady state tests was adopted. One fuel control system, which is illustrative only, is shown schematically in FIG. 16.

When the ignition switch 129 is turned on, fuel is drawn from the fuel tank by an electric fuel pump 130 set to produce a pressure of 6.5 psi in a supply line 131. The fuel passes through a filter 132 connected between the supply line 131 and a fuel feed line 133. A return line 134 is also connected to the filter 132 through a restriction 135 such that fuel in excess of engine demand is constantly filtered and returned to the fuel tank.

From the feed line 133, the fuel is directed to the needle valve 100 through parallel branch lines 136 and 137. Branch line 136 includes a constant pressure regulator 138 set at 4.5 psi and a metering valve 139 controlled by engine manifold vacuum by a diaphragm actuator 140. Excess fuel delivered to the metering valve is returned to the fuel tank through return line 141.

Branch line 137 includes three constant pressure regulators 142–144 connected in series and set at 2.5 psi, 2.0 psi and 1.5 psi, respectively. Connected between regulators 142 and 143 and the downstream end of branch line 137 is a bypass line 145 having a solenoid valve 146. Another bypass line 147 with a solenoid valve 148 is connected between regulators 143 and 144 and the downstream end of branch line 137. A temperature switch 149 and a pressure switch 150 are connected in parallel to solenoid 146 and a temperature switch 151 and pressure switch 152 are connected in parallel to solenoid valve 148.

The temperature switches 149 and 151 are disposed to sense cooling water in the engine jacket and are set to open at 85° F. and 90° F., respectively. The pressure switches 150 and 152 sense manifold vacuum and are set to open at 9 inches and 10 inches of mercury vacuum, respectively. An oil pressure switch 153 set to remain open until oil pressure is detected is connected in series between ground and each of the switches 149–152. A source of electrical potential, such as a 12 volt battery is connected to the other end of the coil of each of the solenoid valves 146 and 148 to complete the respective electrical circuits.

Another bypass line 155 is connected between pressure regulator 138 and a point in the delivery line 68 between the needle valve 100 and the mixing and modulating unit 60. The by-pass 155 includes a pressure accumulator 157 and a pair of spring loaded check valves 158 and 159, one on either side of the accumulator.

The primary path of fuel flow to the unit 60 is through branch line 137 and pressure regulators 142–144 which deliver fuel to the needle valve 100. During initial operation, when the engine is cold, additional fuel is supplied to the needle valve 100 through bypass line 145 until the engine water temperature reaches 85° F. and then through bypass line 147 until the water temperature reaches 90° F. Thereafter primary fuel is delivered through branch line 137, passing through all three pressure regulators 142–144.

As the throttle linkage is moved to open the throat of the modulator 60, a small quantity of supplementary fuel is also delivered to the modulator 60 from the accumulator 157. Check valve 158 is set to open at approximately 4 psi to supply the accumulator, which is in the form of a small piston and cylinder combination, from branch line 136. The other check valve 159 is set to open at approximately 6 psi so that there is no flow through the accumulator until its piston is advanced by the throttle linkage increasing the pressure within the accumulator to above 6 psi.

In the illustrated fuel control system, additional fuel is also supplied to the unit 60 through bypass lines 145 and 147 when the engine is under load and the manifold vacuum drops below 9 and 10 inches Hg., respectively. Progressively more fuel is then supplied through branch line 136 and metering valve 139 when the manifold vacuum drops below 9 inches Hg. It should be appreciated, of course, that the foregoing temperature and pressure conditions are only exemplary and that various other changes and modifications can be made in the fuel control system without departing from the present invention.

As previously mentioned herein, the liquid fuel is supplied to the mixing and modulating device of the present invention in a fuel delivery zone at or before the point of maximum constriction defined between the throat insert and the modulator. This insures that the liquid fuel is subjected to and finely divided by the shearing action of the high velocity air flow which increases to sonic at the throat zone and supersonic just downstream of the throat in the diffuser. Shortly thereafter, the intake air and entrained fuel droplets pass through a sonic shock front or zone in the diffuser and the air abruptly decreases in velocity and the fuel droplets which continue at high velocity relative to the air are then subjected to additional shearing action.

Figure 17:
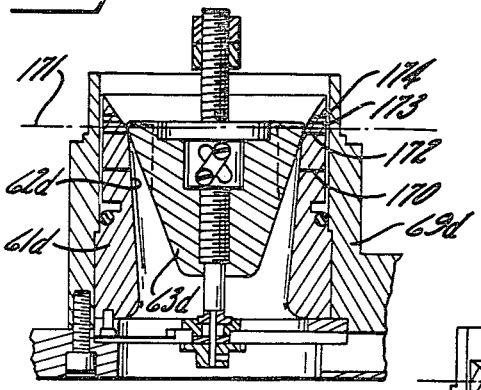
FIG. 17 is a vertical cross-section, similar to FIG. 14, illustrating certain modifications in the device.

A series of experiments have been conducted to investigate the results of introducing the liquid fuel at various points above and below the maximum throat constriction. The throat insert of one of the mixing and modulating devices of the present invention as shown in FIG. 14 was modified as shown in FIG. 17 to provide an annular fuel feed slot 170 approximately ¾ inch below the maximum throat constriction indicated by dash-line 171. This unit was installed on the same 1970 Chevrolet, previously referred to, and tested on the chassis dynamometer in accordance with the same test procedures mentioned above. The results of these tests indicated that the car was operable only at speeds in excess of 55 mph when the fuel slot 170 is located ¾ inch below the maximum throat constriction.

At speeds less than 55 mph, the liquid fuel is not broken up into fine droplets and entrained in the intake air. Rather, the fuel apparently enters the manifold in sporadic streams or slugs and the car is not operable. At speeds in excess of 55 mph, the car would run; however, adjustment of the car for minimum exhaust emissions was extremely difficult, the fuel valve was extremely sensitive, and the fuel pressure had to be reduced to a very low level to achieve control over the emissions. This is believed to be at least partially due to the fact that the fuel feed slot 170 is subjected directly to manifold vacuum conditions when it is located below the throat constriction. The emission results are shown below in Table XIII.

Another test was then conducted with the fuel feed slot 172 located 0.1 inch below the maximum throat constriction. Operation of the car was better and the fuel needle response improved. However, the car still would not operate below 50 mph. The emission results of this test are also presented in Table XIII.

A similar test was conducted with the fuel feed slot 173 located 0.1 inch above the maximum throat constriction. The car now operated at all speeds, but with some difficulty at slower speeds due to the vacuum effect on the fuel slot which caused variation in fuel flow and insensitive needle response. The emission results are presented in Table XIII.

The same experiment was repeated with the fuel feed slot 174 located 0.25 inches above the maximum throat constriction. This permitted operation with higher fuel pressure and better response of the needle but the fuel feed slot was still being affected somewhat by the vacuum due to the close proximity to the throat constriction. The car was operable at all speeds including idle. The emission results are shown in Table XIII.

TABLE XIII

| Feed Slot Location | Speed mph | HC ppm | CO % | $NO_x$ ppm |
|---|---|---|---|---|
| 0.75" below | 61 | 12 | 0.22 | 640 |
| 0.1" below | 60 | 12 | 0.17 | 770 |
| 0.1" below | 54 | 5 | 0.13 | 240 |
| 0.1" above | 45 | 12 | 0.35 | 240 |
| 0.25" above | 47 | 28 | 0.28 | 258 |

It has been previously noted herein that the intake air flowing through the mixing and modulating device of the present invention is accelerated to sonic velocity at the maximum throat constriction and that with an efficient diffuser section, the air flow reaches supersonic velocity just inside the diffuser and then abruptly decreases in velocity as it passes through a sonic shock front. This was confirmed during the course of the experiments mentioned above in connection with the location of the fuel feed slot. A fine gauge hypodermic needle coupled to a vacuum gauge was inserted axially into the annular orifice formed between the insert 61*d* and the modulator 63*d* during operation of the car on the dynamometer. The manifold vacuum was noted and then the needle was withdrawn in measured amounts as successive vacuum readings were recorded throughout the diffuser and throat. Typical results of these tests are graphically plotted in FIG. 18, where O represents the throat constriction and positive values are downstream of the throat and negative values are upstream of the throat.

Figure 18:
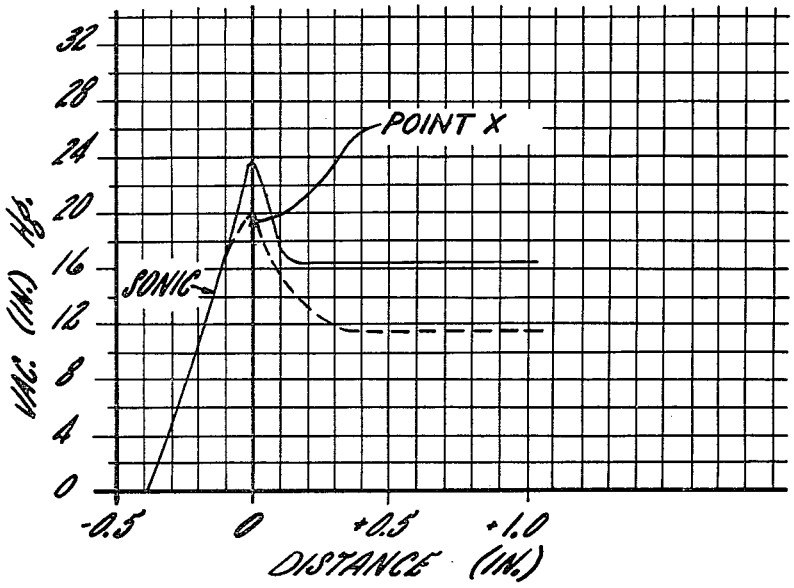
FIGS. 18 and 19 are graphs containing plots of vacuum profiles across the throat of two of the modified devices illustrated in FIG. 17.

The solid curve in FIG. 18 illustrates the vacuum profile measured as the probe is withdrawn axially from the diffuser and the throat of the mixing and modulating device when the manifold vacuum is 16 inches Hg. This, of course, is above the threshold vacuum of 14.3 inches Hg. required to produce sonic velocity at the throat. Moreover, due to the gradually increasing cross-section of the diffuser section, the velocity of the air flow continues to increase above sonic velocity as indicated by that portion of the vacuum profile extending upwardly from the sonic point (14.3" Hg.) to a vacuum reading of 23.5 inches Hg. This sharp rise, from sonic to the supersonic peak occurs over a very short axial distance, only about 0.1 inch in the throat in this particular unit. It will be understood, however, that this distance can vary depending on the specific geometry of the device.

From the supersonic peak, the air velocity then shocks down abruptly, also within about 0.1 inch in this particular unit, as indicated by the sharp drop in the vacuum profile as it returns to the vacuum prevailing generally in the manifold. Both the rapid acceleration of the air to supersonic velocity and the abrupt shock back down to subsonic velocity impose high shear forces on the larger droplets of entrained liquid fuel, resulting in successive push-pull forces on the heavier fuel particles entrained in the air. These high shear forces are instrumental in subdividing any larger drops of liquid fuel into finer droplet form.

Pursuant to the present invention, the supersonic velocity through the mixing and modulating device and the subsequent shock effect in the diffuser section are maintained even at manifold vacuum conditions below that which would normally produce sonic velocity through a simple butterfly-valve-type throttle. This may be seen by reference to the dotted line plot of vacuum profile shown in FIG. 18 where the general manifold vacuum is 11.5 inches Hg., and also by noting that at point X a vacuum of 19.5 inches Hg. was obtained at a manifold vacuum of only 9.5 inches Hg. which is well below the 14.3 inch Hg. sonic point. Therefore, it is clear that even at these low manifold vacuum conditions the diffuser section operates to generate a supersonic peak velocity and subsequent shock back to below sonic velocity, as shown by the vacuum profiles plotted in FIG. 18. It should be understood that the curves plotted in FIG. 18 were obtained from a mixing and modulating device as illustrated in FIG. 17 during the course of the fuel feed slot experiments described above. In other words, these were vacuum profile plots obtained while the 1970 Chevrolet was being operated on the dynamometer. Although the hypodermic probe was very fine and somewhat flattened, vacuum readings below about 11 inches Hg. could not be reliably obtained due to surging of the engine on the dynamometer stand as a result of interfering with the flow of fuel and air through the clearance space provided by the annular orifice between the insert 61 and the modulator 63.

In order to confirm the effect that the diffuser section of the mixing and modulating device illustrated in FIG. 17 had on the generation of high supersonic peak velocities and abrupt sonic shock zones as indicated in FIG. 18, a substantial portion of the diffuser section of the modulator 63*d* was cut away as indicated by dash lines in FIG. 17. Only a 1/16 inch section was left remaining at the very top of this modulator.

Figure 19:
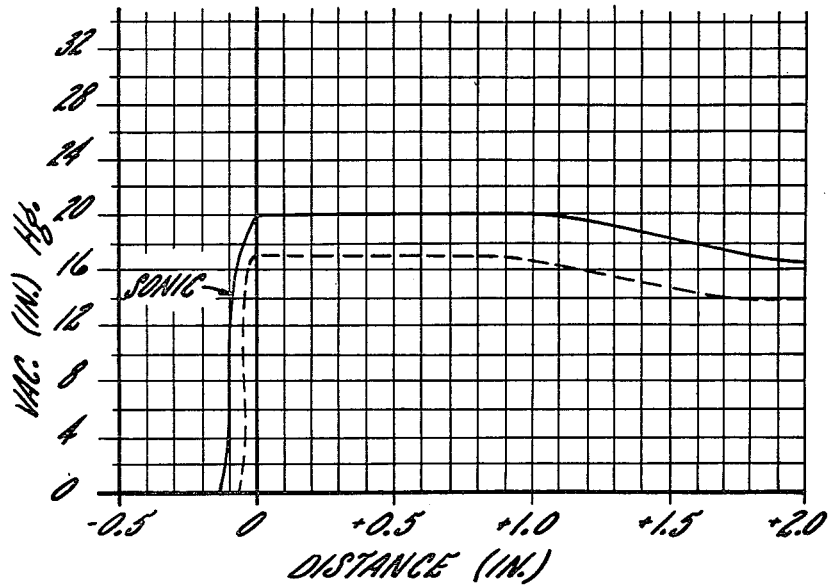

Two vacuum profile plots axially through the throat of the mixing and modulating device as modified above (modulator cut away) are presented in FIG. 19. The solid curve was plotted at a manifold vacuum of 17 inches Hg. and the dotted line curve at 13.5 inches Hg. These values are respectively above and below the threshold vacuum of 14.3 inches Hg. necessary to produce sonic velocity at the throat. Although this modification still resulted in the air velocity going into the supersonic range, the respective peak velocities were much lower than those in FIG. 18 and these velocities were maintained over a much greater distance and then quite slowly reduced to manifold conditions. In other words, the shear forces exerted on the fuel in both the push and pull directions described above were substantially reduced in the modified device as indicated by a comparison of FIGS. 18 and 19. This was confirmed by visual observation of the droplets produced by the modified device. Much larger droplets appeared to be produced by the cutaway modulator, illustrated in dash lines in FIG. 17, than the solid line configuration. The respective manifold vacuums, peak vacuums and vacuum difference (all in inches Hg.) for FIGS. 18 and 19 are tabulated below in Table XIV.

TABLE XIV

| Vacuum Profile | Man. Vac. | Peak Vac. | Vac. Diff. |
|---|---|---|---|
| Fig. 18 | | | |
| solid line | 16.0 | 23.5 | 7.5 |
| dash line | 11.5 | 20.0 | 8.5 |
| point X | 9.5 | 19.5 | 10.0 |
| Fig. 19 | | | |
| solid line | 17.0 | 20.0 | 3.0 |
| dash line | 13.5 | 17.2 | 3.7 |

Since it was clear that the abrupt shock had been lost with the above described modification, another throat insert and modulator as shown in FIG. 14 were obtained for further tests. First, a portion of both the throat insert and modulator in the diffuser section were cut away from a point beginning 1.2 inches below the point of maximum constriction of the throat as shown in the lower dash lines of FIG. 20. This had very little, if any, effect on the efficiency of the diffuser and a plot of the vacuum profile of this device appeared very similar in shape and magnitude to that shown in the solid line curve in FIG. 18.

Figure 20:
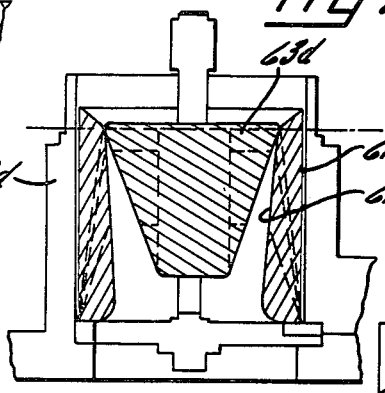
FIG. 20 is a vertical cross-section, similar to FIG. 14, illustrating certain additional modifications of the device.
Figure 21:
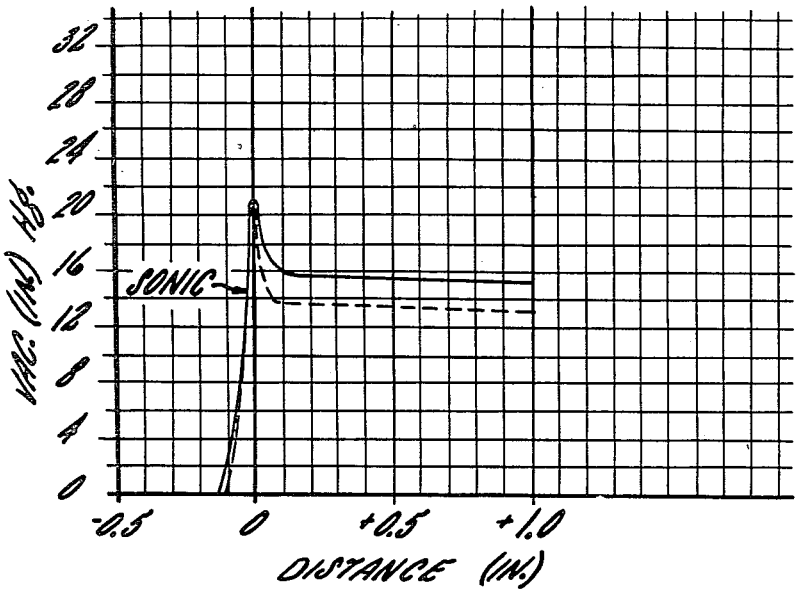
FIGS. 21 and 22 are graphs containing plots of vacuum profiles across the throat of two of the modified devices illustrated in FIG. 20.

Subsequently, the throat insert and modulator were cut away beginning at a point 0.3 inches below the maximum constriction as shown by the intermediate dash lines in FIG. 20. Two plots of the vacuum profile of this device are shown in FIG. 21. The solid curve is at 15.2 inches Hg. manifold vacuum and the dotted line curve at 13.5 inches Hg. vacuum. These values are also intermediate those in FIG. 18 and a comparison of these figures indicates that the respective curves are very similar in both shape and magnitude. Actually, both the rapid rise and fall of the velocity in FIG. 21, occurred over an even shorter axial distance than that in FIG. 18. This indicates that although the diffuser section was now only 0.3 inch long, a sharp supersonic peak velocity and subsequent abrupt shock front were still obtained.

Next, both the insert 61 and modulator 63 were cut away beginning at only 0.1 inch below the point of maximum constriction. This resulted in partial destruction of the diffuser section as may be seen from the two vacuum profiles plotted in FIG. 22.

Figure 22:
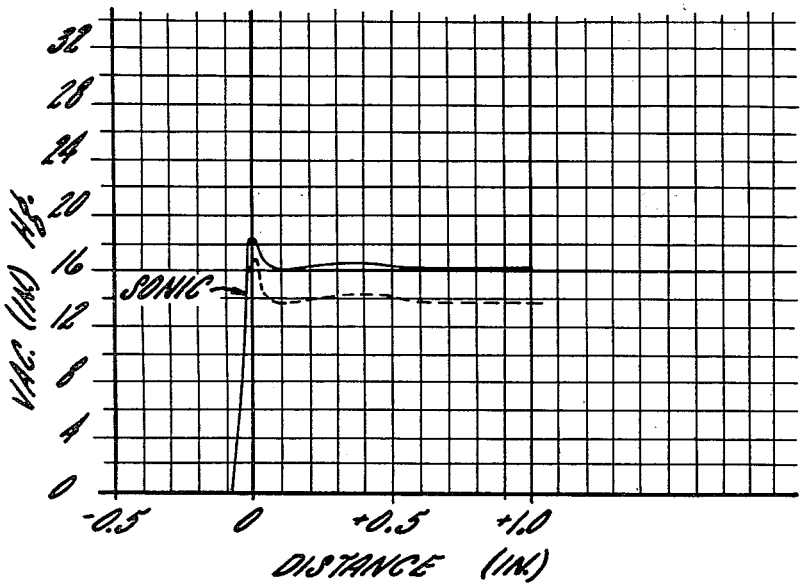

Although the respective values of manifold vacuum plotted here are only slightly below those plotted in FIG. 21, it will be noted that the respective peaks in FIG. 22 are substantially lower than those in FIG. 21. Thus, the efficiency of the diffuser was definitely affected. The respective manifold vacuums, peak vacuums and vacuum difference in inches Hg. for FIGS. 21 and 22 are presented in Table XV.

TABLE XV

| Vacuum Profile | Man. Vac. | Peak Vac. | Vac. Diff. |
|---|---|---|---|
| Fig. 21 | | | |
| solid line | 15.2 | 21.2 | 6.0 |
| dash line | 13.5 | 20.5 | 7.0 |
| Fig. 22 | | | |
| solid line | 14.5 | 18.5 | 4.0 |
| dash line | 13.2 | 16.5 | 3.3 |

In view of the sharp velocity peaks and good shock characteristics as shown in FIG. 21 of the throat insert and modulator combination represented by the central dash line embodiment in FIG. 20, it was decided to run additional seven-mode hot cycles on the 1970 Chevrolet fitted with a type E device having a regular modulator 63 and a throat insert cut away at a 6° angle from a point 0.3 inch below the constriction. Such a type E device is illustrated in the solid line embodiment of FIG. 23 and the results of these tests are presented below in Table XVI.

TABLE XVI

| Fuel | Timing | HC ppm | CO % | $NO_x$ ppm |
|---|---|---|---|---|
| Reg. Unleaded 92 octane | 4°-22° | 29 | 0.15 | 172 |
| 85 Octane unleaded Butane free | 4°-22° | 31 | 0.12 | 179 |
| 75 Octane unleaded Butane free | 4°-22° | 44* | 0.15 | 159 |
| 75 Octane unleaded Butane free | 0°-20° | 24 | 0.14 | 126 |

*Engine was found to have dirty oil which was then changed for the next run.

It will be noted that the data presented on the first line of Table XVI are essentially the same as those in Table XII. This serves to further verify that the modified device (FIG. 23, solid line embodiment) with only a short diffuser section was still quite effective in entraining finely divided fuel droplets in the intake air over the various speed conditions encountered in the seven-mode hot cycle test. In addition, this modified embodiment of the liquid fuel and intake air mixing and modulating device of the present invention also made it possible to operate this high compression ratio (10.25:1) engine not only on low octane, unleaded gasoline but also on such gasoline free of butane.

In view of the indicated importance of maintaining sonic velocity and a subsequent shock front in the mixing and modulating device of the present invention, an attempt was made to determine at what manifold vacuum level this condition would be lost. As previously noted, the level of manifold vacuum at which the device just fails to maintain sonic velocity at the throat is referred to herein as the unchoking point.

Initially, data from the foregoing tests was collected and plotted for those manifold vacuum conditions for which the probe technique had been employed. By extrapolating these data it was concluded that the mixing and modulating devices C (FIG. 11) and E (solid line FIG. 23) had unchoke points of about 3.5 inches Hg. and 5.5 inches Hg., respectively.

These extrapolated values were subsequently verified on bench test equipment and more sensitive instrumentation which became available for further experiments.

The bench tests established that the mixing and modulating device C illustrated in FIG. 11 had unchoke points ranging between 3.3 to 3.7 inches Hg., respectively, at conditions simulating engine operating speeds from idle to 50 mph. The unchoke points for the mixing and modulating device D illustrated in FIG. 14 were found to range between 5.5 to 6.5 inches Hg., for speeds corresponding to idle and 50 mph, respectively. In addition, the type E device having a throat insert with a cut-away diffuser section together with a standard modulator (solid line embodiment of FIG. 23) was found to have similar unchoke points ranging between 5.5 to 6.5 inches Hg.

During actual operation of the mixing and modulating device C (FIG. 11) as well as during the above-mentioned bench tests, the modulator 63 is located well below the position shown in FIG. 11. This results in a much narrower annular orifice 65 and also exposes a portion of the converging duct portion 62, above the top of modulator 63, as a lead-in to the annular orifice 65. Since the angle of convergence of this throat portion is 28°, the half angle or slope of each wall portion is 14° with respect to the center line. In contrast, the modified devices illustrated in the solid line embodiments of FIGS. 20 and 23 have a half angle of 50° for the converging entrance portion leading into the fixed point of maximum constriction.

A series of additional experiments on the above-mentioned bench test equipment has now established that changes in the entrance half angle to the throat constriction have a definite effect on the unchoking points of the mixing and modulating devices of the present invention. First, the entrance half angle of the throat insert shown in FIG. 14 was changed from 50° to 25° as shown in the lower dash line of FIG. 23. The unchoke points remained about the same, i.e. 5.5 to 6.5 inches Hg. vacuum at 50 mph, but the performance at idle appeared better. Next, the entrance half angle was changed to 15° as shown in the upper dash line of FIG. 23. This resulted in a significant reduction of the respective unchoke points to 3.7 to 4.2 inches Hg. vacuum from idle to 50 mph. It will also be noted that those values are very close to the unchoke points of 3.3–3.7 inches Hg. obtained for device C (FIG. 11) having an entrance half angle of 14°.

Figure 23:
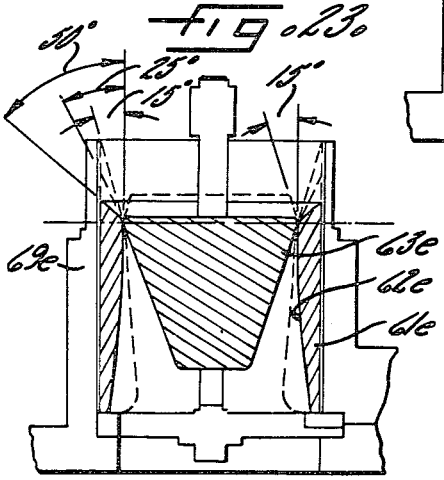
FIG. 23 is a vertical cross-section similar to FIG. 14, illustrating certain additional modifications of the device.

A further modification of the device shown in FIG. 23 was made by extending the top of the modulator as shown in dotted lines such that it too had an entrance half angle of about 15°. When this modulator was tested with the modified throat insert having an entrance half angle of 15°, the unchoke point at 50 mph was reduced from 4.2 to 3.5 inches Hg. vacuum. However, the unchoke point at idle increased from 317 to 5.5 inches Hg. vacuum. Another test was then made with the extended modulator and the original throat insert having a 50° half angle entrance. This resulted in unchoke points of 3.5 and 5.5 inches Hg. vacuum, respectively, at idle and 50 mph, essentially the reverse of the preceding modification. It would appear that the optimum entrance half angle for the mixing and modulating device illustrated in FIG. 23 is somewhere between these illustrated embodiments.

Figure 24:
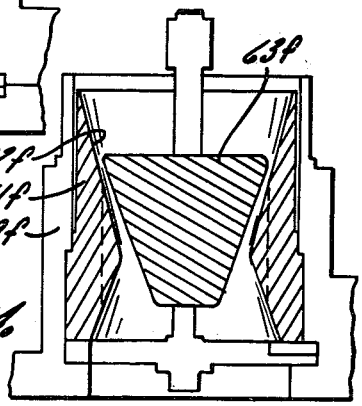
FIG. 24 is a vertical cross-section, similar to FIG. 11, illustrating a modification of this device.

While the foregoing changes in the entrance half angle demonstrate the importance of this parameter in extending the range of operating conditions at which sonic velocity can be maintained, the importance of at least a short and efficient diffuser section should not be overlooked. In this connection, the unchoke points for the mixing and modulating device C (FIG. 11) were lowered by 1.2 inch Hg. by cutting away a portion of the diffuser as shown in dash lines in FIG. 24. The respective unchoke points for this embodiment were 2.7 and 3.2 inches Hg. vacuum, respectively, for idle and 50 mph. These are the best results that have thus far been obtained with one of the mixing and modulating devices of the present invention that has also been suitable for installation on an automobile engine to produce the significant reductions in exhaust emissions described herein.

In theory, however, it would appear that the unchoke points could be further extended down to perhaps as low as 1 to 2 inches Hg. by providing an entrance half angle on the order of about 6° together with a nearly optimized diffuser section. However, both of these factors would tend to increase the axial extent of the mixing and modulating device and also require a correspondingly greater amount of axial movement of the modulator in order to cover the full range of engine operating conditions as compared with the embodiments of the invention disclosed and described herein. Whether such a theoretically optimized unit could be practically fitted within the engine compartment of an automobile remains to be seen. Moreover, since engine intake vacuum rarely drops below about 5 inches Hg., except under extremely aggressive driving conditions, it will be appreciated that either of the embodiments of the present invention illustrated in FIGS. 11 and 14 provide for sonic velocity of the intake air over substantially the entire range of engine operation. Finally, as indicated in connection with the modifications discussed in connection with FIGS. 23 and 24 either of these embodiments can be rather easily modified to lower their unchoke points down to about 2.5–3.5 inches Hg. vacuum should it be deemed necessary or desirable to extend the range of engine operating conditions to this degree.

The operation of the liquid fuel and intake air mixing and modulating device of the present invention is quite different than that of a conventional carburetor. First, although conventional carburetors employ one or more venturi sections in which the velocity of intake air is increased, these venturi sections are provided for the purpose of metering the amount of fuel fed into the intake air. In order to achieve this metering function, the venturi must operate far below the sonic velocity, because once sonic velocity is reached, the flow through the venturi is fixed and the ability of the venturi to perform its metering function is lost. Second, although the butterfly-valve throttle in a conventional carburetor does produce sonic velocity over a portion of the range of intake manifold vacuum conditions at which the engine is operated, i.e. at vacuum conditions above about 12 inches Hg., as its typical unchoked point its range is obviously quite limited. Third, such throttle constrictions do not produce sharp supersonic peak velocities and abrupt shock fronts because there is no effective diffuser section associated with the throttle and the throttle opening is asymmetric. The absence of such a diffuser section also results in the velocity of the intake air falling well below sonic velocity when the manifold vacuum drops below the unchoking point of about 12 inches Hg.

In contrast, the liquid fuel and intake air mixing and modulating device of the present invention is effective to produce sonic velocity at the throat and supersonic velocity peaks and subsequent abrupt shock fronts in the diffuser section over substantially the entire range of engine operations conditions. The shearing action provided by these sharp velocity gradients breaks the liquid fuel into finely divided droplets so that a substantial and useful portion of the liquid fuel remains entrained in the intake air as it passes into the intake manifold. Due to the nature and uniformity of the resulting air-fuel charge, combustion is more complete over a wide range of air-fuel ratios and takes place at a lower temperature and possibly by a somewhat modified combustion process. As a result, undesirable exhaust emissions are substantially reduced and at the same time the engine is capable of operating on unleaded fuel having a much lower octane rating than would otherwise be required.

While the invention has been described in connection with certain preferred embodiments and procedures in the foregoing specification, we do not intend the invention to be limited thereby. Rather, the invention should be construed as embracing such alternate and equivalent embodiments as fall within the scope of the appended claims.

What is claimed is:

1. A method for delivering a gaseous medium at a controlled mass flow rate to a downstream location subject to a range of variable pressure conditions comprising the steps of flowing a gaseous medium from an upstream entry point toward the downstream location, passing the gaseous medium through a variable area constricted zone to increase the velocity thereof to sonic, passing the gaseous medium immediately downstream from the variable area constricted zone through a zone of gradually increasing cross-sectional area substantially corresponding to that of a conical section having an apex angle in the range of about 6° to 18° and having an exit comprising the downstream location in order to gradually reduce the velocity of the gaseous medium and efficiently recover kinetic energy as static pressure, and adjustably varying the cross-sectional areas of the constricted zone and the zone of gradually increasing cross-sectional area in accordance with mass flow rate requirements of associated equipment in communication with the downstream location and to which the gaseous medium is to be delivered whereby the kinetic energy of the gaseous medium recovered as static pressure within the zone of gradually increasing cross-sectional area maintains the velocity of the gaseous medium through the constricted zone sonic when the pressure at the downstream location is at or below a predetermined value less than the gaseous medium pressure at the entry point but substantially more than 60% thereof so that the mass flow rate of the gaseous medium, at a given entry temperature and pressure, is directly proportional to, and is determined by the cross-sectional area of the constricted zone.

2. A method as in claim 1 wherein the gaseous medium pressure at the entry point is atmospheric.

* * * * *

UNITED STATES PATENT AND TRADEMARK OFFICE

CERTIFICATE OF CORRECTION

PATENT NO. : 4,231,383

DATED : November 4, 1980

INVENTOR(S) : James F. Eversole et al

It is certified that error appears in the above–identified patent and that said Letters Patent are hereby corrected as shown below:

On the cover page as well as Col. 1, lines 7-8

"now U.S. Pat. No. 4,023,125" should read -- now abandoned --.

Col. 5, line 4, "in" should read -- is --

Col. 5, last line, "line" should read -- lines --

Col. 15, line 9, "92" should read -- 93 --

Col. 16, in Table V, "B" should appear immediately following the word "Unit" rather than below that word Signed and Sealed this

*Twelfth* Day of *May 1981*

[SEAL]

*Attest:*

RENE D. TEGTMEYER

*Attesting Officer*

*Acting Commissioner of Patents and Trademarks*

REEXAMINATION CERTIFICATE (164th)

United States Patent [19]

Eversole et al.

[11] B1 4,231,383

[45] Certificate Issued * Feb. 14, 1984

[54] METHOD FOR CONTROLLING MASS FLOW RATE

[75] Inventors: James F. Eversole, Mamaroneck, N.Y.; Lester P. Berriman, Irvine, Calif.

[73] Assignee: Dresser Industries, Inc., Dallas, Tex.

Reexamination Requests:
No. 90/000,006, Jul. 1, 1981
No. 90/000,132, Dec. 23, 1981

Reexamination Certificate for:

| | |
|---|---|
| Patent No.: | **4,231,383** |
| Issued: | **Nov. 4, 1980** |
| Appl. No.: | **7,946** |
| Filed: | **Jan. 31, 1979** |

[ * ] Notice: The portion of the term of this patent subsequent to Dec. 11, 1990 has been disclaimed.

Certificate of Correction issued May 12, 1981.

Related U.S. Application Data

[60] Continuation of Ser. No. 622,521, Oct. 15, 1975, Pat. No. 4,023,125, which is a division of Ser. No. 388,761, Aug. 16, 1973, Pat. No. 3,952,776, which is a continuation-in-part of Ser. No. 151,373, Jun. 9, 1971, Pat. No. 3,778,038, which is a continuation-in-part of Ser. No. 17,086, Mar. 6, 1970, abandoned.

[51] Int. Cl.[3] ..... F02M 9/00

[52] U.S. Cl. ..... 137/1; 261/50 R; 261/DIG. 56; 261/DIG. 78

[56] References Cited

U.S. PATENT DOCUMENTS

| | | | |
|---|---|---|---|
| 2,061,852 | 11/1936 | Schweitzer | 251/34 |
| 2,240,119 | 4/1941 | Montgomery et al. | 73/207 |
| 2,332,916 | 10/1943 | Johnson . | |
| 2,570,629 | 10/1951 | Anxionnaz | 60/355 |
| 2,696,110 | 12/1954 | Eggers | 73/147 |
| 2,726,073 | 12/1955 | Seld . | |
| 2,877,004 | 3/1959 | Barr | 261/64 |
| 2,933,922 | 4/1960 | Davis | 73/147 |

(List continued on next page.)

OTHER PUBLICATIONS

Arnberg, B. T., "Review of the Critical-Flow Meter for Gas Flow Measurements", J. Basic Eng., pp. 447–460 (1962).

(List continued on next page.)

*Primary Examiner*—Alan Cohan

[57] ABSTRACT

A combustible mixture of air and minute fuel droplets is produced for supply to the cylinders of an internal combustion engine. This mixture is formed by accurately controlling both the atomization of fuel and the mass flow rate of air over substantially the entire operating range of the engine. These controls are accomplished by introducing liquid fuel into a stream of intake air and uniformly distributing the fuel in the air followed by passing the air and fuel mixture through a constricted zone to increase the velocity of the mixture to sonic. The sonic velocity air at the constricted zone divides the fuel into minute droplets that are uniformly entrained throughout the air stream. The area of the constricted zone and the quantity of fuel introduced are adjustably varied in correlation with operating demands imposed upon the engine. Downstream from the constricted sonic zone, the air and fuel mixture is accelerated to supersonic velocity in a supersonic zone without imparting substantial turbulent flow thereto. Thereafter the mixture is decelerated to subsonic velocity in a subsonic zone to produce a shock zone where the fuel droplets entrained in the air are believed to be further subdivided and uniformly distributed throughout the combustible mixture before the mixture is supplied to the engine cylinders. The supersonic and subsonic velocities occur in a gradually increasing cross-sectional area corresponding to that of a conical section having an apex angle in the range of about 6 to 18 degrees.

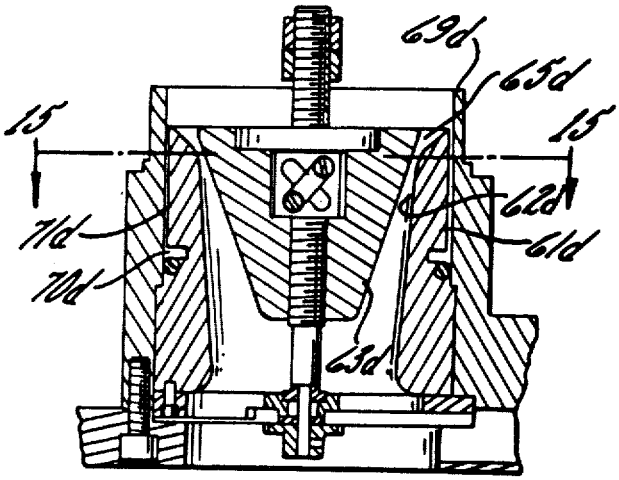

U.S. PATENT DOCUMENTS

| | | | |
|---|---|---|---|
| 2,939,775 | 6/1960 | Middleton et al. | 48/180 |
| 3,204,459 | 9/1965 | Lehrer | 73/213 |
| 3,393,964 | 7/1968 | Donnelly | 431/2 |
| 3,524,344 | 8/1970 | Converse . | |
| 3,534,908 | 10/1970 | Coleman | 239/265.43 |
| 3,544,061 | 12/1970 | Moy | 251/24 |
| 3,559,373 | 11/1971 | Garrett | 55/9 |
| 3,643,914 | 2/1972 | Bake | 251/124 |
| 3,851,523 | 3/1974 | Converse et al. | 73/118 |
| 3,896,670 | 7/1975 | Converse et al. | 73/213 |

OTHER PUBLICATIONS

Howard, J. H. G., H. J. Henseler, and A. B. Thornton--Trump, "Performance and Flow Regimes for Annular Diffusers", ASME Paper 67-WA/FE-21, Annual Meeting and Energy Systems Exposition, Pittsburgh, Pa., Nov. 12-17, 1967.

Patterson, G. N., "Modern Diffuser Design", Aircraft Eng., pp. 267-273 (1938).

"Fox Adjustable Area Venturies" (Fox I).

"Fox Remote Operated Throttle Valves for Flow Control Proportioning, Metering of all Fluids & Gases", by Fox Development Co. Oct., 1967, pp. 50452-50457 (Fox II).

"Fox Adjustable Area Venturies (Throttle Valves) For Flow Metering & Control of Chemicals, Fluids, Gases & Vapors", Mar. 1970 (Fox III).

"The Cavitating Venturi"-M&D Measurements and Data, Jul./Aug., 1976.

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 2, having been finally determined to be unpatentable, are cancelled.

New claim 3 is added and determined to be patentable.

*3. A method for delivering a gaseous medium at a controlled mass flow rate to a downstream location subject to a range of variable pressure conditions comprising the steps of flowing a gaseous medium from an upstream entry point toward the downstream location, passing the gaseous medium through a variable area constricted zone to increase the velocity thereof to sonic, passing the gaseous medium immediately downstream from the variable area constricted zone through a zone of gradually increasing cross-sectional area, said zone of gradually increasing cross-sectional area being formed by the cooperating internal surface of an outer duct and the cooperating external surface of a modulator element moveable axially in said duct, the cooperating surface of said outer duct being shaped with an apex angle outside the downstream divergence range of 6° to 18° and the cooperating surface of the modulator element being shaped to form, together with the cooperating internal surface of the outer duct, an efficient diffuser which corresponds to a conical diffuser having an apex angle in the range of about 6° to 18° in order to gradually reduce the velocity of the gaseous medium and efficiently recover kinetic energy as static pressure, and adjustably varying the cross-sectional areas of the constricted zone and the zone of gradually increasing cross-sectional area in accordance with mass flow rate requirements of associated equipment in communication with the downstream location and to which the gaseous medium is to be delivered whereby the kinetic energy of the gaseous medium recovered as static pressure within the zone of gradually increasing cross-sectional area maintains the velocity of the gaseous medium through the constricted zone sonic when the pressure at the downstream location is at or below a predetermined value less than the gaseous medium pressure at the entry point but substantially more than 60% thereof so that the mass flow rate of the gaseous medium, at a given entry temperature and pressure, is directly proportional to, and is determined by the cross-sectional area of the constricted zone.*

* * * * *